US006505014B2

(12) United States Patent
Aoki et al.

(10) Patent No.: US 6,505,014 B2
(45) Date of Patent: Jan. 7, 2003

(54) IMAGE FORMING APPARATUS AND AN IMAGE FORMING PROCESS UNIT

(75) Inventors: Katsuhiro Aoki, Kanagawa (JP); Hisashi Shoji, Kanagawa (JP); Tsukuru Kai, Kanagawa (JP); Hajime Oyama, Chiba (JP); Noriyoshi Tarumi, Tokyo (JP); Takashi Hodoshima, Kawagawa (JP); Yasuo Miyoshi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/964,794

(22) Filed: Sep. 28, 2001

(65) Prior Publication Data

US 2002/0039496 A1 Apr. 4, 2002

(30) Foreign Application Priority Data

Sep. 29, 2000 (JP) ..... 2000-299011
Sep. 29, 2000 (JP) ..... 2000-300640

(51) Int. Cl.[7] ..... G03G 15/06
(52) U.S. Cl. ..... 399/55; 399/56; 399/159; 399/270
(58) Field of Search ..... 399/55, 56, 258, 399/259, 265, 267, 270, 272, 276, 277, 159

(56) References Cited

U.S. PATENT DOCUMENTS 4,967,231 A * 10/1990 Hosoya et al. ..... 399/267
5,109,254 A 4/1992 Oka et al.
5,172,169 A 12/1992 Takashima et al.
5,220,383 A 6/1993 Enoki et al.
5,239,344 A 8/1993 Enoki et al.
5,245,391 A 9/1993 Suzuki et al.
5,286,918 A 2/1994 Iwata et al.
5,311,263 A 5/1994 Suzuki et al.
5,339,141 A 8/1994 Suzuki et al.
5,341,196 A 8/1994 Hodoshima et al.
5,389,733 A 2/1995 Enoki et al.
5,394,231 A 2/1995 Sudo et al.
5,416,568 A 5/1995 Yoshiki et al.
5,424,814 A 6/1995 Suzuki et al.
5,450,177 A 9/1995 Oyama
5,451,713 A 9/1995 Suzuki et al.
5,474,869 A 12/1995 Tomita et al.
5,508,794 A 4/1996 Ikesue et al.
5,565,973 A 10/1996 Fujishiro et al.
5,598,254 A 1/1997 Ikesue et al.
5,627,630 A 5/1997 Matsumae et al.
5,655,193 A 8/1997 Fujishiro et al.
5,659,860 A 8/1997 Sasaki et al.

(List continued on next page.)

FOREIGN PATENT DOCUMENTS

JP 2001-034067 2/2001
JP 2001-117353 4/2001

*Primary Examiner*—Hoang Ngo
(74) *Attorney, Agent, or Firm*—Oblon, Spivak, McClelland, Maier & Neustadt, P.C.

(57) ABSTRACT

An image forming apparatus of the present invention includes an image carrier made up of a conductive base and photoconductive layer and a toner carrier to which a bias for development is applied. The toner carrier conveys toner deposited thereon to a developing position where the toner carrier faces the image carrier, thereby developing a latent image formed on the image carrier. The apparatus effects low-voltage development that protects the image carrier from electrostatic fatigue, obviates background contamination, and realizes image density as high as 0.5 $\times 10^{-3}$ g/cm2 or above in terms of the amount of toner deposition. Further, the apparatus implements faithful development of the latent image by reducing the edge effect. An image forming process unit removable from the apparatus is also disclosed.

38 Claims, 23 Drawing Sheets

U.S. PATENT DOCUMENTS 5,674,408 A 10/1997 Suzuki et al.
5,741,616 A 4/1998 Hirano et al.
5,771,426 A 6/1998 Oka et al.
5,774,772 A 6/1998 Kai et al.
5,805,965 A 9/1998 Tsuda et al.
5,819,145 A 10/1998 Tanaka et al.
5,822,664 A 10/1998 Oka et al.
5,864,733 A 1/1999 Mae et al.
5,915,155 A 6/1999 Shoji et al.
6,081,684 A 6/2000 Naganuma et al.
6,125,243 A 9/2000 Shoji et al.
6,160,979 A * 12/2000 Shoji ..... 399/267
6,163,669 A 12/2000 Aoki et al.

* cited by examiner

*Fig. 13*

| PARAMETER | NUMERICAL VALUE |
|---|---|
| CHARGE POTENTIAL ON DRUM (BACKGROUND) : VO | −450∼−500V |
| POTENTIAL AFTER EXPOSURE (IMAGE) : VL | −50∼−100V |
| SURFACE ROUGHNESS OF BRUSH ROLLER : Rz | 5∼50 μm |
| NORMAL FLUX DENSITY OF POLE N2 OF BRUSH ROLLER | 60mt OR ABOVE |
| HALF VALUE OF POLE N2 BRUSH OF ROLLER Q1/2 | 40±5° |
| BIAS FOR TONER SUPPLY : $V_{SUD}$ | −350V |
| BIAS FOR DEVELOPMENT : VB | −250V |
| POTENTIAL FOR DEVELOPMENT : VL−VB | +150∼200V |
| TONER SUPPLY POTENTIAL : VB−VA | +100V |
| TONER CONTENT OF 2-INGREDIENT DEVELOPER : TC | 2∼10 Wt/% |
| TONER CHAEGE OF 2-INGREDIENT DEVELOPER : Q/M | −5∼−25 μC/g |
| VOLUME MEAN GRAIN SIZE OF TONER | 3∼12 μm |
| VOLUME MEAN GRAIN SIZE OF CARRIER | 20∼50 μm |
| LINEAR VELOCITY OF DRUM : Vp | 200mm/sec |
| LINEAR VELOCITY OF BRUSH ROLLER : Vs | 650mm/sec |
| LINEAR VELOCITY OF DEVELOPING ROLLER : VD | 250mm/sec |
| GAP BETWEEN BRUSH ROLLER & DOCTOR | 0.5∼0.6mm |
| AMOUNT OF DEVELOPER OF MAGNET BRUSH ON BRUSH ROLLER | 0.03∼0.05mg/$cm^2$ |
| GAP BETWEEN BRUSH ROLLER & DEVELOPING ROLLER | 0.35∼0.45mm |
| BITE OF DEVELOPING ROLLER INTO DRUM (DIMENSION) | 0.1∼0.3mm |

*Fig. 18*

| PARAMETER | NUMERICAL VALUE |
|---|---|
| BEAM SPOT DIAMETER | 70×80mm |
| QUANTITY OF LIGHT | 0.23mW |
| CHARGE POTENTIAL OF DRUM (BACKGROUND) : VO | −600V |
| POTENTIAL AFTER EXPOSURE (IMAGE) : VL | −120V |
| BIAS FOR DEVELOPMENT : VB | −420V |
| POTENTIAL FOR DEVELOPMENT : VL−VB | +300V |
| CHARGE ON TONER : Q/M | −10∼−30μC/g |
| DIAMETER OF DRUM | 50mm |
| DIAMETER OF DEVELOPING ROLLER | 18mm |
| LINEAR VELOCITY OF DRUM : VP | 200mm/sec |
| LINEAR VELOCITY OF DEVELOPING ROLLER : VD | 300mm/sec |
| GAP BETWEEN DEVELOPING ROLLER & DOCTOR | 0.5mm |
| GAP BETWEEN DEVELOPING ROLLER & DRUM | 0.4mm |

| | 60 | 80 | 100 |
|---|---|---|---|
| 60 | 3.3 | 3.0 | 2.3 |
| 80 | 3.4 | 3.1 | 2.6 |
| 100 | 4.2 | 3.6 | 3.2 |
| 120 | 4.7 | 4.1 | 3.5 |
| 140 | 5.2 | 4.4 | 3.7 |
| 160 | 5.7 | 4.9 | 4.0 |
| 180 | 6.1 | 5.1 | 4.1 |

| EVALUTION BY EYE | EDGE EFFECT RANK | Ep/Esol |
|---|---|---|
| ○ | 5 | 2.0 OR BELLOW |
| ○ | 4 | 2.1 ~ 3.0 |
| △ | 3 | 3.1 ~ 4.5 |
| × | 2 | 4.0 ~ 6.0 |
| × | 1 | 6.1 OR ABOVE |

| | EMBODIMENT | COMP. EXAMPLE |
|---|---|---|
| THICKNESS OF LAYER (μm) | 15 | 30 |
| INITIAL CHARGE POTENTIAL VO (V) | −250 | −700 |
| POTENTIAL AFTER EXPOSURE VL (V) | −50 | −120 |
| \| VO − VL \| | 200 | 580 |
| CHARGE ON CURRENT SUPPLY (μC/cm²) | 31.8 | 46.2 |
| RATIO | 1 | 1.45 |

*Fig. 34*

| | (A) CHARGE OF TONER FED [μC/g] | (B) CHARGE OF TONER IN LAYER [μC/g] | RATIO OF (A) TO (B) [%] | IMAGE CHARACTERISTIC (BACKGROUND CONTAMINATION RANK) |
|---|---|---|---|---|
| EMBODIMENT | −15±2 | −12±2 | 125 | 5 |
| PRIOR ART | −3±2 | −12±2 | 25 | 3 |

Fig. 37

| | No. 1 | No. 2 | No. 3 | No. 4 | No. 5 |
|---|---|---|---|---|---|
| THICKNESS OF RUBBER LAYER OF DEVELOPING ROLLER (μm) | 4000 | 4000 | 4000 | 4000 | 3000 |
| SPECIFIC INDUCTIVE CAPACITY OF DEVELOPING ROLLER | 200 | 200 | 200 | 250 | 200 |
| DIELECTRIC THICKNESS OF DEVELOPING ROLLER | 20 | 20 | 20 | 16 | 15 |
| THICKNESS OF TONER LAYER (μm) | 10 | 10 | 10 | 10 | 10 |
| SPECIFIC INDUCTIVE CAPACITY OF TONER | 3 | 3 | 3 | 3 | 3 |
| DIELECTRIC THICKNESS OF TONER LAYER | 3.3 | 3.3 | 3.3 | 3.3 | 3.3 |
| THICKNESS OF PHOTOCONDUCTOR (μm) | 15 | 20 | 30 | 20 | 20 |
| SPECIFIC INDUCTIVE CAPACITY OF PHOTOCONDUCTOR | 3 | 3 | 3 | 3 | 3 |
| DIELECTRIC THICKNESS OF PHOTOCONDUCTOR | 5 | 6.7 | 10 | 6.7 | 6.7 |
| EDGE REPRODUCIBILITY | × | × | ○ | ○ | ○ |

IMAGE FORMING APPARATUS AND AN IMAGE FORMING PROCESS UNIT

BACKGROUND OF THE INVENTION

1. Field of the Invention

The present invention relates to a copier, printer, facsimile apparatus or similar image forming apparatus and more particularly to an image forming apparatus of the type including an image carrier made up of a conductive base and a photoconductive layer and a toner carrier to which a bias for development is applied, and transferring toner from the toner carrier to the image carrier at a developing position to thereby develop a latent image formed on the image carrier, and an image process unit for the same.

2. Description of the Background Art

An image forming apparatus of the type described includes a developing device operable with a single-ingredient type developer, i.e., toner or a two-ingredient type developer consisting of toner and magnetic grains. A developing device using a single-ingredient type developer includes a developing roller or toner carrier on which toner is directly deposited in the form of a layer. The developing roller conveys the toner to a developing position where the roller faces an image carrier carrying a toner image thereon. At the developing position, the toner layer on the toner carrier is transferred to the image carrier by an electric field, which is formed by a bias applied to the conductive base of the developing roller.

A developing device using a two-ingredient type developer includes a sleeve or toner carrier on which magnetic grains form a magnet brush. Charged toner electrostatically deposits on the magnet brush and is conveyed to a developing position in accordance with the rotation of the sleeve. At the developing position, the magnet brush with the toner adjoins or contacts an image carrier on which a latent image is formed. A bias applied to the sleeve forms an electric field in such a manner as to transfer the toner from the magnet brush to the latent image.

Japanese Patent Nos. 2,983,262 and 2,987,254, for example, each disclose a developing device operable with a single-ingredient type developer and including a developing roller or image carrier and a blade. The developing roller faces an image carrier while the blade is pressed against the developing roller in order to form a thin toner layer. More specifically, the blade charges toner deposited on the developing roller by friction while regulating the thickness of the toner layer. The thin toner layer adjoins or contacts the image carrier to thereby develop a latent image formed on the image carrier.

In the developing device described above, the blade, a toner feed roller or similar contact member controls charge to deposit on the toner by using friction. This frictional charging scheme, however, cannot readily meet a demand for high-speed charge control over toner or a demand for high durability of toner. Further, the contact member pressed against the toner carrier stresses the toner deposited on the toner carrier and is therefore apt to bring about toner filming. At the same time, the contact member is likely to cause a substance covering each toner grain to penetrate into the toner grain, deteriorating image quality. Moreover, the contact member and toner carrier wear due to friction and cause a developing characteristic to vary with the elapse of time.

The developing device using the two-ingredient type developer can deposit charged toner on the toner carrier without resorting to the blade, toner feed roller or similar contact member, i.e., friction. For example, Japanese Patent Laid-Open Publication Nos. 56-40862, 59-172662, 5-66677 and 10-240019 each propose to cause the developer to form a magnet brush on a magnet roller, magnet brush forming body or similar toner feed member. Toner contained in the magnet brush is charged to preselected polarity by friction acting between the toner and magnetic grains. Only part of the toner charged to preselected polarity is transferred from the toner feed member to the toner carrier, e.g., a developing roller or a toner layer support body.

To insure a preselected developing ability, a relatively high charge potential may be caused to deposit on the photoconductive layer of the image carrier in order to increase a potential for development, as proposed in the past. The potential for development refers to a difference between a potential deposited on the latent image of the image carrier and the bias for development. However, the relatively high potential accelerates, e.g., the electrostatic fatigue of the image carrier. In this sense, a low-voltage development using a relatively low potential is desirable. However, if the charge potential to deposit on the photoconductive layer of the image carrier is low, it is likely that the background of an image is contaminated or that the amount of toner deposition becomes too short to implement preselected image density. This problem arises without regard to the type of the developer, i.e., the single-ingredient type developer or the two-ingredient type developer.

In light of the above, we conducted a series of researches and experiments and found the following. The conductive base of the image carrier and the conductive base of the toner carrier form an equivalent circuit therebetween. By optimizing a capacity and a resistance constituting the equivalent circuit, it was possible to realize low-potential development and form images with a minimum of background contamination and with preselected density.

There is an increasing demand for an image forming apparatus featuring the sharpness of an image and the faithful reproduction of tonality. To meet this demand, a developing ability is essential that faithfully develops even latent images representative for thin lines and small dots. Further, toner must be prevented from depositing on the image carrier in an excessive amount; otherwise, the toner would be scattered around in the event of image transfer from the image carrier to a recording medium or would spread during fixation. However, the conventional developing process is apt to bring about a so-called edge effect that increases the amount of toner to deposit on fine lines, small dots and the edges of solid images. It has therefore been difficult to faithfully develop latent images representative of thin lines and small dots for thereby forming uniform images.

The edge effect that obstructs faithful reproduction occurs without regard to the type of the developer as well. The edge effect is particular serious with the two-ingredient type developer because a gap for development between the toner carrier and the image carrier is as great as several hundred micrometers.

As stated above, the edge effect makes desirable image formation difficult without regard to the type of the developing apparatus or the type of the developer. The edge effect is particularly noticeable with the developing device using the two-ingredient type developer because the gap between the toner carrier and the image carrier is as great as several hundred micrometers.

The developing device using the one-ingredient type developer is advantageous in that only the toner can be stably charged and deposited on the toner carrier, obviating irregular development despite non-contact development. However, even this kind of developing device cannot sufficiently reduce the edge effect and therefore has the problems discussed earlier.

In. light of the above, we conducted a series of extended researches and experiments and found that the edge effect could be reduced if a preselected relation was set up between the capacity of a region adjoining the surface of the image carrier and where toner contributing to development is present and the capacity of the photoconductive layer of the image carrier.

Technologies relating to the present invention are also disclosed in, e.g., Japanese Patent Laid-Open Publication Nos. 2001-34067 and 2001-117353.

SUMMARY OF THE INVENTION

It is a first object of the present invention to provide an image forming apparatus capable of implementing low-potential development, reducing background contamination, and forming an image having target density of $0.5\times10^{-3}$ g/cm$^2$ in terms of the amount of toner deposition, and an image forming process unit therefor.

It is a second object of the present invention to provide an image forming apparatus capable of reducing the edge effect to thereby promote faithful development of a latent image, and an image forming process therefor.

In accordance with the present invention, an image forming apparatus includes an image carrier including a photoconductive layer formed on a conductive base. A latent image forming device uniformly charges the surface of the image carrier and then scans the surface with a light beam in accordance with image data to thereby form a latent image. A developing device deposits toner on a toner carrier, which includes a conductive base, and causes the toner carrier to convey the toner to a developing position where the toner carrier faces the image carrier to thereby develop the latent image and produce a corresponding toner image. A power supply applies a bias $V_B$ for development to the conductive base of the toner carrier. An image transferring device transfers the toner image from the image carrier to a recording medium. Assume that a capacity and a resistance between the conductive base of the toner carrier and the surface of the photoconductive layer in the developing region are $C_D$ (F/cm$^2$) and $R_D$ ($\Omega$cm$^2$)D respectively. Also, assume that the photoconductive layer has a capacity of $C_P$ (F/cm$_2$) and a resistance, as measured in the thickness of direction, of $R_P$ ($\Omega$/cm$^2$), and that a potential for development that is a difference between the potential $V_L$ of the image portion of the image carrier and the bias $V_B$ ($V_L-V_B$) is 300 V or below in absolute value. Then, $C_D$, $R_D$, $C_P$, and $R_P$ are selected such that the amount of charge $Q_P$ to be charged into the capacity $C_P$ for a unit area within a period of time in which the surface of the image carrier moves away from the developing position. is $2.5\times10^{-9}$ C/cm$^2$ in absolute value.

Further, in accordance with the present invention, an image forming apparatus includes an apparatus body and an image carrier including a photoconductive layer formed on a conductive base. A latent image forming device uniformly charges the surface of the image carrier and then scans the surface with a light beam in accordance with image data to thereby form a latent image. A developing device deposits toner on a toner carrier, which includes a conductive base, and causes the toner carrier to convey the toner to a developing position where the toner carrier faces the image carrier to thereby develop the latent image and produce a corresponding toner image. A power supply applies a bias $V_B$ for development to the conductive base of the toner carrier. An image transferring device transfers the toner image from the image carrier to a recording medium. A region adjoining the surface of the image carrier at the developing position and where the toner contributing to development exists has a capacity $C_{TL}$ for a unit area greater than the capacity $C_{PC}$ of the photoconductive layer for a unit area.

BRIEF DESCRIPTION OF THE DRAWINGS

The above and other objects, features and advantages of the present invention will become more apparent from the following detailed description taken with the accompanying drawings in which:

FIG. 13 is a table listing various parameters used in the illustrative embodiment;

FIG. 18 is a table listing various parameters used in the embodiment of FIG. 14;

FIG. 34 is a table comparing the illustrative embodiment and a conventional developing device with respect to the amount of charge of toner to be fed to the developing roller and that of toner deposited on the developer;

FIG. 37 is a table showing the results of experiments conducted by varying the thickness of the photoconductive layer, the thickness of the elastic layer of the developing roller, and the thickness of the toner layer.

DESCRIPTION OF THE PREFERRED EMBODIMENTS

Preferred embodiments of the present invention will be described hereinafter.

Figure 1:
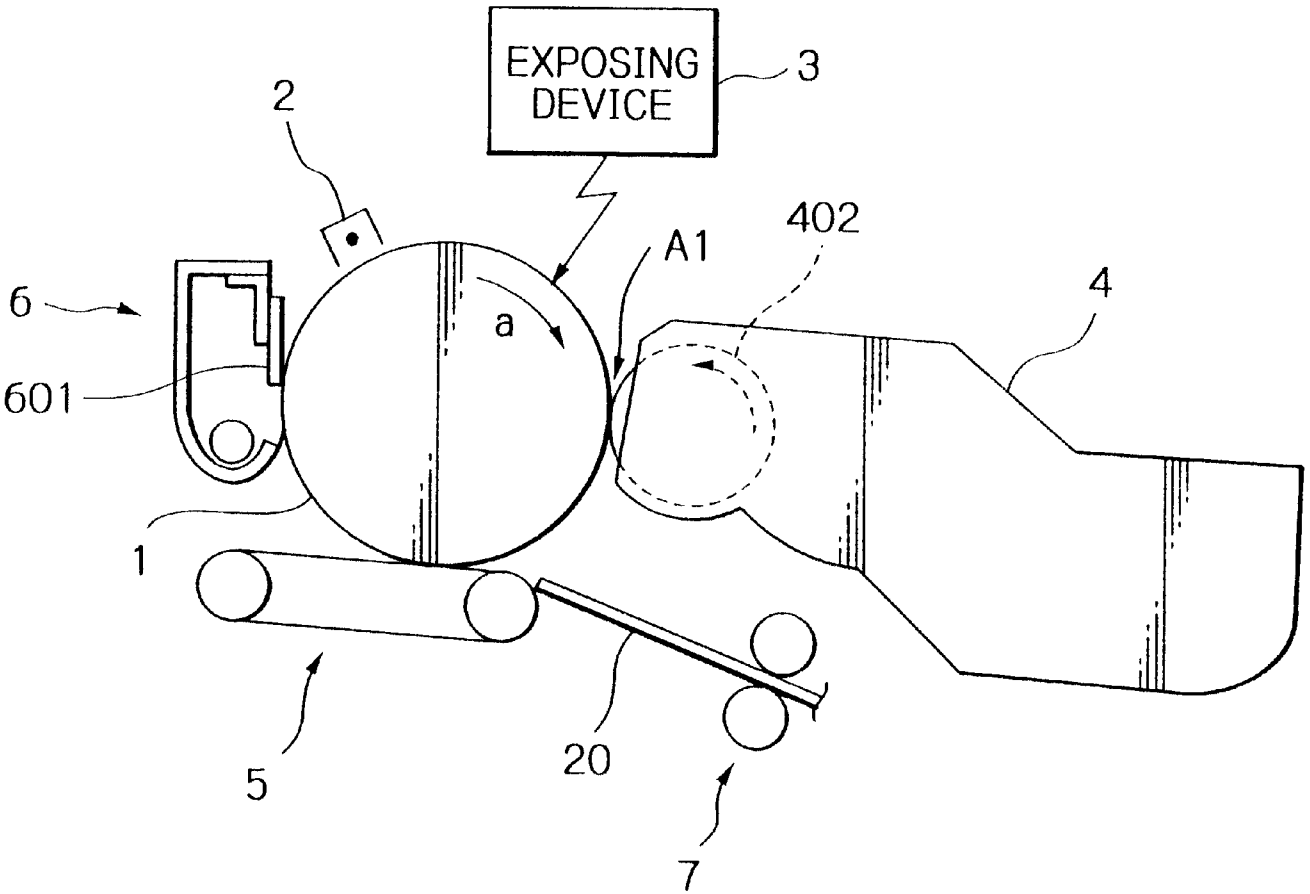
FIG. 1 a view showing an image forming apparatus embodying the present invention.

Referring to FIG. 1 of the drawings, an image forming apparatus embodying the present invention and mainly directed toward the first object is shown and implemented as an electrophotographic laser printer by way of example. As shown, the printer includes a photoconductive drum (simply drum hereinafter) 1 that is a specific form of an image carrier. A charger 2, an exposing device 3, a developing device 4, an image transferring device 5 and a cleaning device 6 are sequentially arranged around the drum 1. The charger 2 uniformly charges the surface of the drum 1. The exposing device 3 scans the charged surface of the drum 1 with, e.g., a laser beam modulated in accordance with image data, thereby forming a latent image on the drum 1. The developing device 4 develops the latent image with toner to thereby form a corresponding toner image. The image transferring device 5 transfers the toner image to a paper sheet or similar recording medium 20. The cleaning device 6 removes the toner left on the drum 1 after the image transfer. The charger 2 and exposing device 3 constitute latent image forming means in combination.

A sheet feeder, not shown, feeds paper sheets stacked on a sheet tray one by one. A fixing device, not shown, fixes the toner image from the drum 1 to the paper sheet 20.

Figure 2:
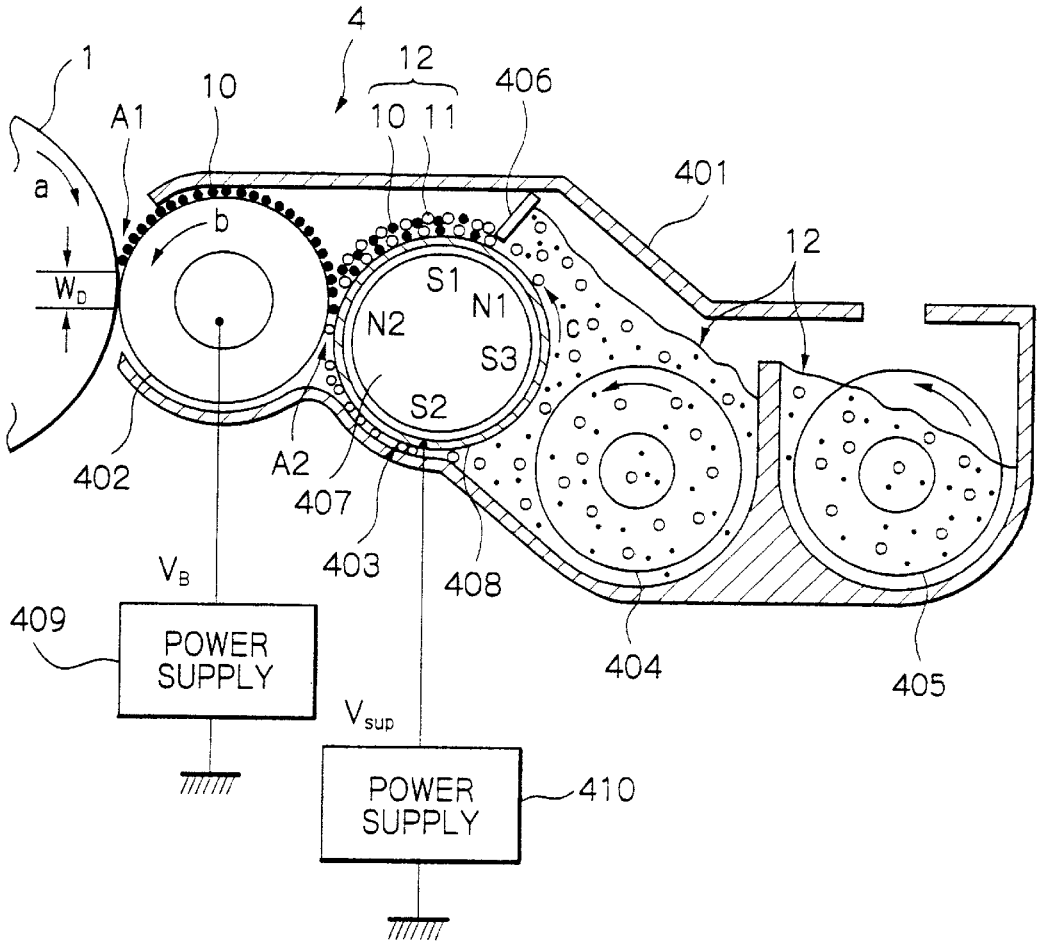
FIG. 2 is a view showing a developing device included in the illustrative embodiment.

FIG. 2 shows the developing device 4 specifically. As shown, the developing device 4 includes a casing 401 accommodating a developing roller, a magnet brush roller 403, and agitators 404 and 405 sequentially arranged, as illustrated. The developing roller 402 adjoins the drum 1 and plays the role of a developer carrier. The casing 401 stores a two-ingredient type developer 12, i.e., a mixture of toner grains 10 and magnetic grains 11. The agitators 404 and 405 agitate the developer 12 while conveying it to the magnet brush roller 403. Part of the developer 12 agitated by the agitators 404 and 405 deposits on the magnet brush roller 403 in the form of a layer. The magnet brush roller 403 conveys the developer 12 to a toner feeding position A2 while a doctor blade 406 regulates the thickness of the developer layer. At the toner feeding position A2, the developer on the magnet brush roller 403 contacts the developing roller 402, so that only the toner 10 is transferred to the developing roller 402.

The magnet brush roller 403 is made up of a stationary magnet member 407 having a plurality of magnetic poles and a nonmagnetic, rotatable sleeve 408 surrounding the magnet member 407. The magnetic member 407 exerts a magnetic force when the developer 12 passes preselected positions on the sleeve 408. More specifically, the magnet member 407 has an N pole (N1), an S pole (S1), an N pole (N2), an S pole (S2) and an S pole (S3) as named in the direction of rotation of the sleeve 408 from the position where the doctor blade 406 meters the developer layer. Of course, such an arrangement of magnetic poles is only illustrative and may be modified in matching relation to the position of, e.g., the doctor blade 406 around the magnet brush roller 403. Also, an arrangement may be made such that the magnet member 407 rotates relative to the sleeve 408 held stationary.

The developer 13 made up of the toner 10 and magnetic grains 11 forms a brush on the sleeve 408 due to the magnetic force of the magnet member 407. The toner 10 present in the magnet brush formed on the magnet brush roller 403 is charged by a preselected amount by being mixed with the magnetic grains 11. The amount of charge to deposit on the toner should preferably be between $-5\ \mu C/g$ to $-35\ \mu C/g$.

In the illustrative embodiment, an imaginary line connecting the pole N1 of the magnet member 407 and the axis of the magnet member 407 is inclined relative to an imaginary line connecting the doctor blade 406 and the above axis toward the upstream side in the direction of rotation of the roller 403. This allows the developer 12 to be easily circulated in the casing 401. The angle of inclination of the pole N1 may advantageously be between 0° and 15°.

The pole N2 of the magnet brush roller 403 adjoins the toner feeding position A2 where the magnet brush on the roller 403 contacts the developing roller 402. The developing roller 402 and drum 1 are pressed against each other at a developing position A1, forming a nip having a preselected width $W_D$. The doctor blade 406 regulates the amount of the developer 12 deposited on the magnet brush roller 4, so that the developer 12 is conveyed to the toner feeding position A1 in a preselected amount. At the same time, the doctor blade 406 promotes the frictional charging of the toner 10 and magnetic grains 11. Drivelines, not shown, rotate the developing roller 402 and magnet brush roller 403 in directions b and c, respectively. The surface of the developing roller 402 and that of the magnet brush roller 403 therefore move in opposite direction to each other, as seen as the toner feeding position A2.

A power supply 409 is connected to the shaft portion of the developing roller 402 in order to apply a bias of $V_B$. for forming an electric field for development at the developing position A1. Likewise, a power supply 410 is connected to the sleeve 408 in order to apply a bias of $V_{sup}$ for forming an electric field for toner supply at the toner feeding position A2.

Figure 3:
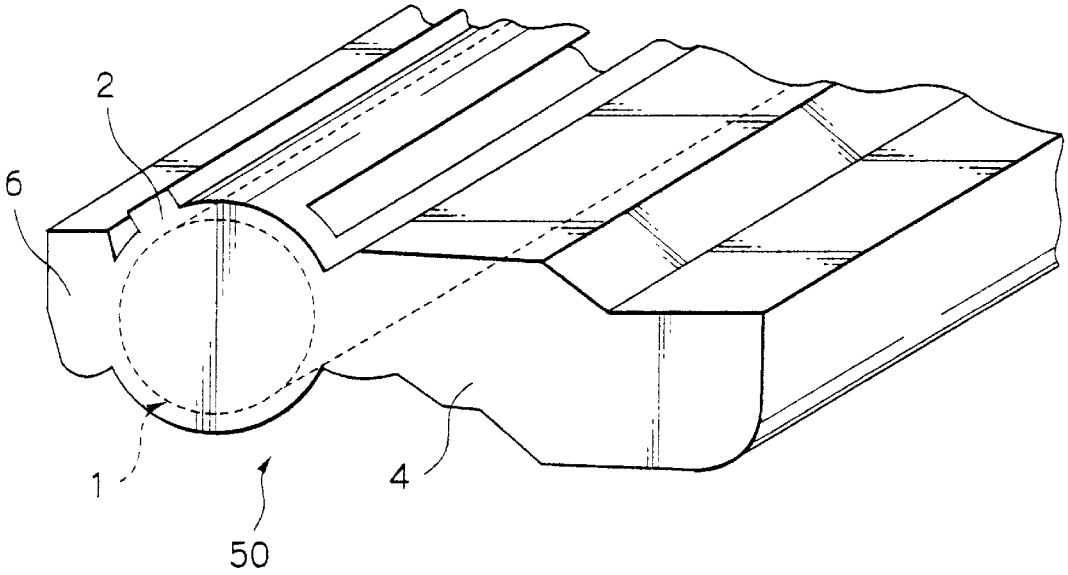
FIG. 3 is an isometric view showing a process unit included in the illustrative embodiment.

Part of the devices constituting the printer may be constructed into a unit removable from the printer body. For example, as shown in FIG. 3, the drum 1, charger 2, developing device 4 and cleaning device 6 may be constructed into a single process unit 50 removably mounted to the printer body.

Referring again to FIG. 1, in operation, the charger 2 uniformly charges the surface of the drum 1 being rotated in a direction a. The exposing device 3 scans the charged surface of the drum 1 with a laser beam modulated in accordance with image data, thereby forming a latent image on the drum 1. The developing device 4 develops the latent image by depositing the toner on the drum 1 at the developing position A1 to thereby form a corresponding toner image. The paper sheet 20 is fed from the sheet feeder to a registration roller pair 7 by a conveyor not shown. The registration roller pair 7 drives the paper sheet at a preselected timing toward an image transfer position where the drum 1 and image transferring device 5 face each other. The image transferring device 5 charges the paper sheet 20 to polarity opposite to the polarity of the toner image, thereby transferring the toner image from the drum 1 to the paper sheet 20.

The paper sheet 20 with the toner image is separated from the drum 1 and then conveyed to the fixing device. The fixing device fixes the toner image on the paper sheet 20. The cleaning device 6 removes the toner left on the drum 1 after the image transfer.

Figure 4:
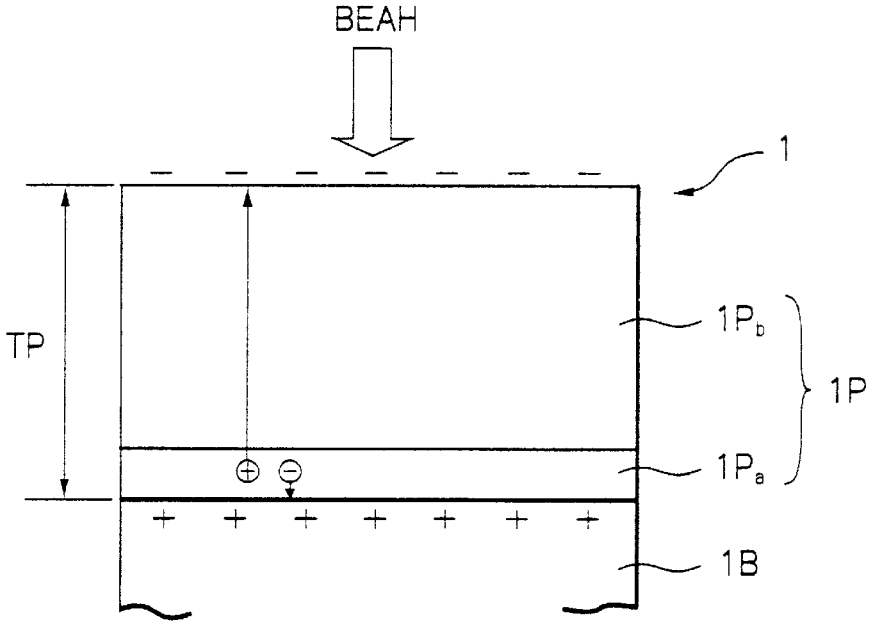
FIG. 4 is a section showing the surface portion of a photoconductive drum included in the illustrative embodiment.

The drum 1, toner and developing roller 402 that characterize the illustrative embodiment will be described hereinafter. As shown in FIG. 4, the drum 1 is made up of a conductive, tubular base 1B and a photoconductive layer 1P formed on the base 1B. The base 1B is formed of, e.g., aluminum and connected to ground. The photoconductive layer 1P is formed by coating an organic or inorganic photoconductor on the base 1B. The layer 1P is made up of a charge generation layer 1P*a* and a charge transport layer 1P*b*. In the illustrative embodiment, the charger 2 uniformly charges the surface of the drum 1 to negative polarity.

Figure 5:
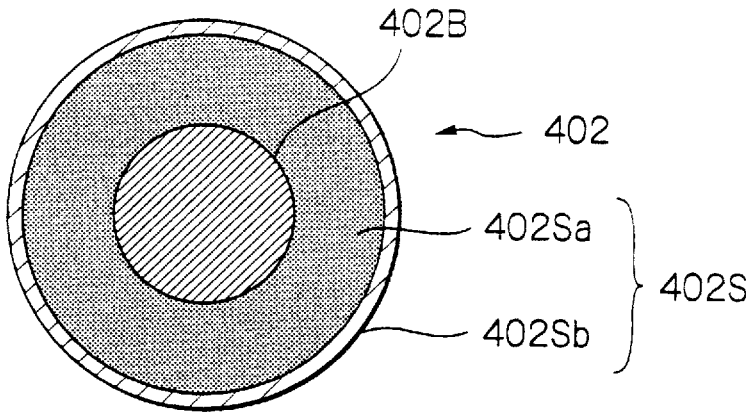
FIG. 5 is a section showing the configuration of a developing roller included in the developing device.

As shown in FIG. 5, the developing roller 402 is made up of a conductive base or core 402B and an elastic surface layer 402S. The elastic surface layer 402S is made up of an elastic layer 402S*a* and a surface protection layer 402S*b*. The developing roller 402 should preferably have a diameter ranging from 10 mm to 30 mm and a surface roughness Rz ranging from 1 $\mu$m to 4 $\mu$m in terms of ten-point mean roughness. This range of surface roughness Rz is 13% to 80% of the volume mean grain size of the toner 10 and allows the toner 10 to be conveyed without being buried in the surface of the developing roller 402. It is to be noted that when the image carrier is implemented as a photoconductive belt, the developing roller 402 may be formed of, e.g., metal because its hardness does not have to be lowered.

Figure 6:
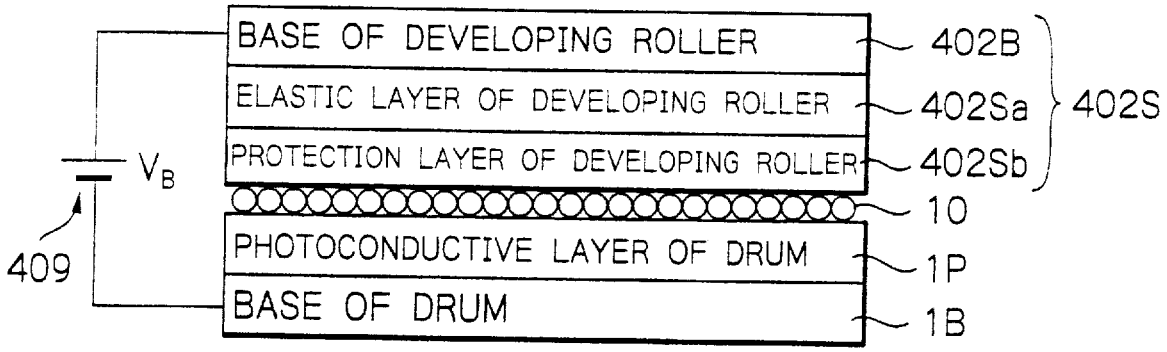
FIG. 6 schematically shows a relation between the conductive base of the drum and the core of the developing roller at a developing position.
Figure 7:
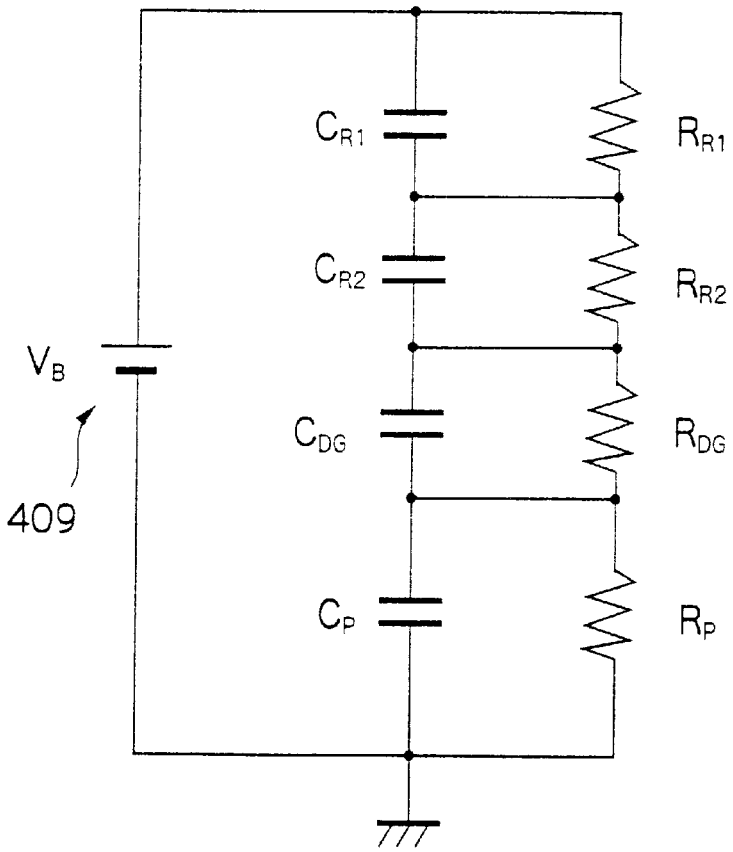
FIG. 7 is a circuit diagram showing an equivalent circuit between the conductive base of the drum and the core of the developing roller at the developing position.
Figure 8:
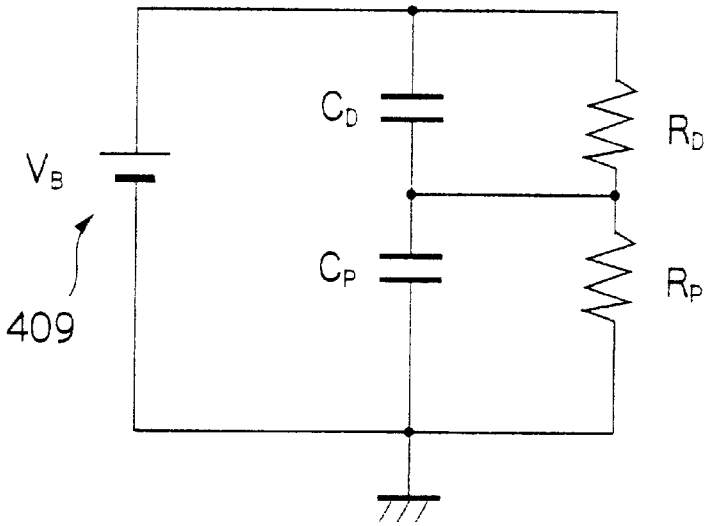
FIG. 8 is a circuit diagram showing a simplified from of the equivalent circuit.

FIG. 6 shows a relation between the conductive base (aluminum tube) 1B of the drum 1 and the core 402B of the developing roller 402, as seen at the developing position A1. FIG. 7 shows an equivalent circuit representative of the above relation. Further, FIG. 8 shows part of the equivalent circuit including the surface layer of the developing roller 402 and a gap for development. As shown, assume that a capacity and a resistance between the core 402B of the developing roller 402 and the photoconductive layer 1P of the drum 1 are $C_D$ F/cm$^2$ and $R_D$ $\Omega$/cm$^2$, respectively, and that the layer 1P has a capacity of $C_P$ F/cm$^2$ and has a resistance of $R_P$ $\Omega$/cm$^2$ in the direction of thickness. Also, assume that the elastic layer 402S*a* of the developing roller 402 has a capacity of $C_{R1}$ F/cm$^2$ and has a resistance of $R_{R1}$ $\Omega$/cm$^2$ in the direction of thickness. Further, assume that the gap between the surface of the developing roller 402 and that of the drum 1 has a capacity of $C_{DG}$ F/cm$^2$ and a resistance of $R_{DG}$ $\Omega$/cm$^2$.

When the surface of the drum 1 arrives at the nip at the developing position A1, charge is charged into the capacity of the photoconductive layer 1P of the drum 1. The amount of this charge $Q_P$ C/cm$^2$ injected for a unit area while the surface of the drum 1 moves over the nip width corresponds, in absolute value, to the amount of charge of the toner to deposit on the image formed on the photoconductive layer 1P for a unit area of the toner. Moreover, the value $Q_P$ can be represented by a product of the amount of toner M/A g/cm$^2$ to deposit on the image when the surface of the layer 1P passes the developing position A1 and the mean amount of charge Q/M C/g conveyed to the position A1 by the developing roller 402.

Assume that a potential for development, i.e., a difference between the potential $V_L$ of the image formed on the drum 1 and the bias $V_B$ for development ($V_L$–$V_B$) is 300 V or below. Then, the illustrative embodiment selects the capacities $C_D$ and $C_P$ and resistances $R_D$ and $R_L$ such that, under the above potential condition, the amount of charge $Q_P$ for a unit area has an absolute value of $2.5\times10^{-9}$ C/cm$^2$ or above. This allows the toner whose mean amount of charge Q/M has an absolute value of $5\times10^{-6}$ C/g or above to deposit on the image formed on the photoconductive layer 1P in an. amount M/A of $0.5\times10^{-3}$ g/cm$^2$ or above.

Particularly, after the capacities $C_D$ and $C_P$ have been fully charged within the period of time in which the surface of the drum 1 moves over the entire nip width, no charging current flows. In this condition, the amounts of charge charged into the capacities $C_D$ and $D_P$ are equal to each other. In addition, the above amount of charge is represented by a product of a composite capacity $C_T$ derived from the serial connection of the capacities $C_D$ ($C_{R1}$, $C_{R2}$ and $C_{DG}$) and $C_P$ and the absolute value of the potential for development. Therefore, as for the absolute value of potential of 300 V or below, if the composite capacitance $C_T$ is $8.3\times10^{-12}$ F/cm$^2$ or below, the amount of charge $Q^P$ for a unit area can have the absolute value of $2.5\times10^{-9}$ C/cm$^2$ or above.

Assume that the composite capacity $C_D$ of the serial connection of the capacities $C_{R1}$, $C_{R2}$ and $C_{DG}$ and the capacity $C_P$ of the photoconductive layer 1P differ from each other. Then, the composite capacity $C_T$ is closer to smaller one of the capacities $C_D$ and $C_P$. Consequently, the amount of charge to be charged into the composite capacity $C_T$ is determined substantially by the amount of charge to be charged into smaller one of the capacities $C_D$ and $C_P$. It follows that by controlling smaller one of the capacities $C_D$ and $C_P$ to $8.3\times10^{-12}$ F/cm$^2$, it is possible to provide the amount of charge $Q_P$ with an absolute value of $5\times10^{-9}$ C/cm$^2$.

In the equivalent circuit shown in FIG. 8, so long as a relation of $R_D<<R_P$ holds, the potential for development may be considered to act between the aluminum tube 1B and the photoconductive layer 1P of the drum 1. Therefore, if the absolute value of the above potential is 300 V or below, and if the capacity $C_L$ of the layer 1P is $8.3\times10^{-12}$ F/cm$^2$ or above, then the amount of charge $Q_P$ for a unit area can be $2.5\times10^{-9}$ C/cm$^2$ or above.

Figure 9:
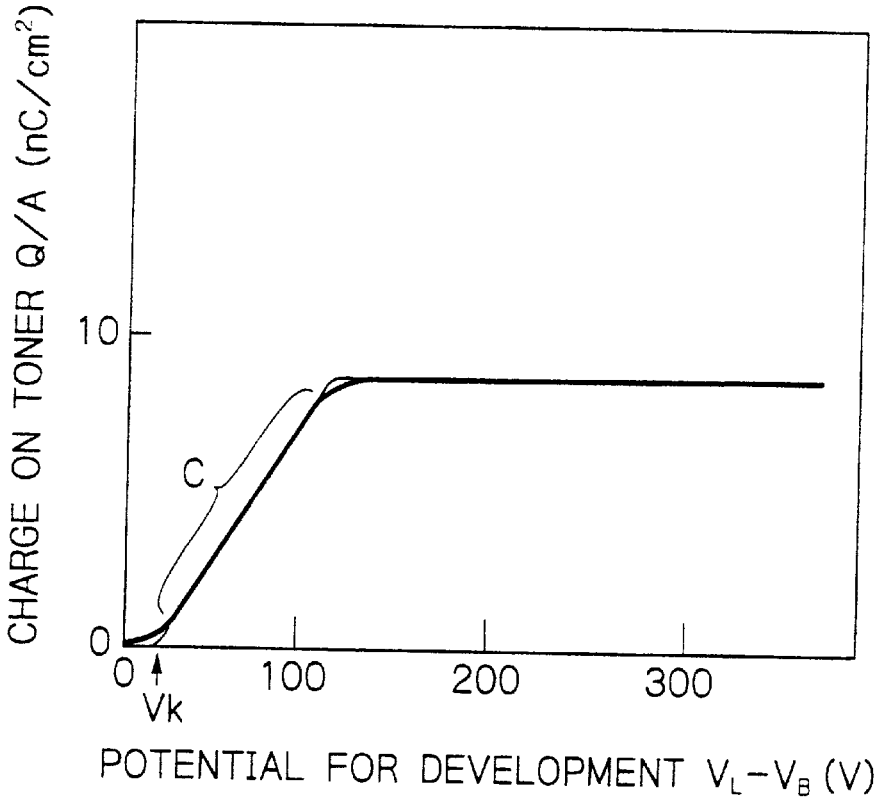
FIG. 9 is a graph showing a relation between a potential for development and the amount of toner to deposit on toner.

FIG. 9 shows a curve representative of a gamma characteristic or developing characteristic, i.e., a relation between the potential for development and the amount of charge of toner Q/A (nC/cm$^2$). So long as the relation $R_D<<R_P$. holds, the capacity $C_P$ of the photoconductive layer 1P corresponds to the slope $\alpha$ of the linear rising portion C included in the curve. Therefore, if the slope $\alpha$ is $8.3\times10^{-12}$ F/cm$^2$ or above, the amount of charge $Q_P$ for a unit area can have an absolute value of $2.5\times10^{-9}$ C/cm$^2$. The slope a is expressed as $(Q/A)/(V_L-V_B-V_K)$ in FIG. 9. The potential $V_L$ is the potential of the image where the potential is lowered by exposure, i.e., the area where the toner is expected to deposit. The voltage $V_K$ corresponds to a development start voltage and is represented by a point where the extension of the rising portion C intersects the abscissa.

In. the graph of FIG. 9, the saturation amount of charge of the toner is $9\times10^{-9}$ C/cm$^2$, i.e., the saturation amount of toner deposition and the amount of charge of toner are 0.6 mg/cm$^2$ and 15 $\mu$C/g, respectively. Therefore, the slope $\alpha$ of the rising portion C is $90\times10^{-12}$ F/cm$^2$. The rising portion C is not always linear. Presumably, when the rising portion C is not linear, the maximum slope $\alpha$ of the rising portion C corresponds to the capacity $C_T$ and the capacity $C_P$ of the photoconductive layer 1P.

The development effected at the developing position A1 may be considered to correspond to the charging of the capacity $C_P$ of the photoconductive layer 1P. In addition, a period of time necessary for the capacity $C_P$ to be sufficiently charged may be considered to be equal to the time constant $R_{D\times CP}$ of a circuit including the capacity $C_P$, developing roller 402 serially connected to the capacity $C_P$, and resistance RD of the gap for development. Therefore, by controlling the resistance $R_D$ to $T_D/C_P$ or below, it is possible to complete the charging of the capacity $C_P$, i.e., the development of a latent image formed on the photoconductive layer 1P within a period of time $T_D$ in which the latent image moves over the nip width.

Under the condition $R_D<<R_P$ stated earlier, the maximum slope $\alpha$ of the linearly rising portion C, FIG. 9, corresponds to the capacity $C_P$ of the photoconductive layer 1P. The resistance $R_D$ may therefore be $T_D/\alpha$ or below.

Assume that the nip at the developing position A1 has a width $W_D$ in the direction in which the surface of the drum 1 moves, and that the surface of the drum 1 moves at a velocity of $V_P$. Then, the period of time $T_D$ mentioned earlier can be expressed as $W_P/V_P$. Also, assume that the absolute value of the potential for development is 300 V or below, as stated earlier, and that the nip width $W_D$ is 1 mm or above. Then, if the velocity $V_P$ is as high as 500 mm/sec, then the charge of $2.5\times10^{-9}$ C/cm$^2$ or above in absolute value can be charged into the capacity $C_P$ of the photoconductive layer 1P if the resistance $R_D$ of the layer 1P is $2.4\times10^8$ $\Omega$/cm$^2$or below. Consequently, it is possible to deposit the toner whose mean amount of charge Q/M is $5\times10^6$C/g or above in absolute value on the image of the layer 1P by the amount M/A of $0.5\times10^{-3}$ g/cm$^2$.

For example, as to the specific curve of FIG. 9, the slope $\alpha$ of the linear portion C is $90\times10^{-12}$ F/cm$^2$, as stated earlier. Therefore, if the linear velocity of the drum 1 is 330 mm/sec and if the nip width is 1 mm, the resistance $R_D$ is $3.37\times10^7$ $\Omega$/cm$^2$.

The resistance $R_D$ should preferably be $1\times10^3$ /cm$^2$ or above. Such a resistance successfully reduces leak current between the core 402B of the developing roller 402 and the surface of the photoconductive layer 1P of the drum1 1 and thereby insures stable development.

Figure 10:
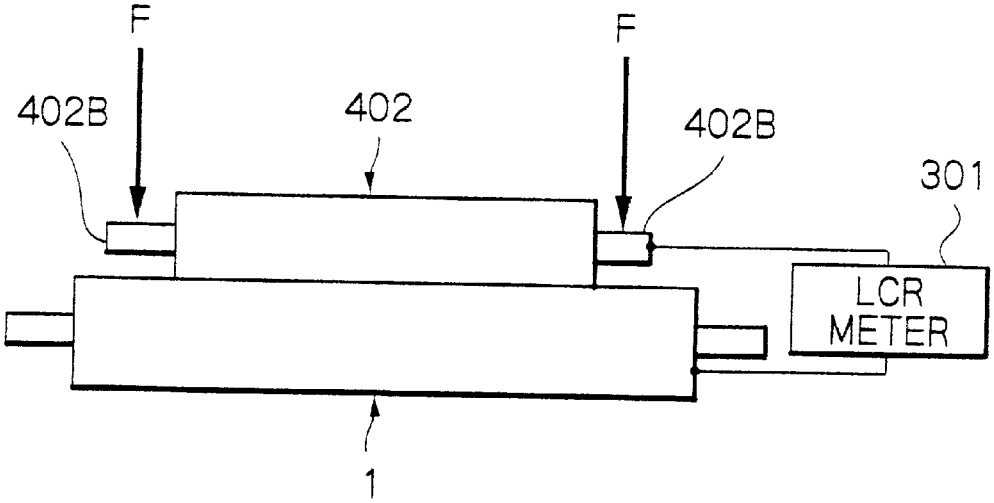
FIG. 10 is a front view showing a specific system for measuring a capacity and a resistance in the equivalent circuit.
Figure 11:
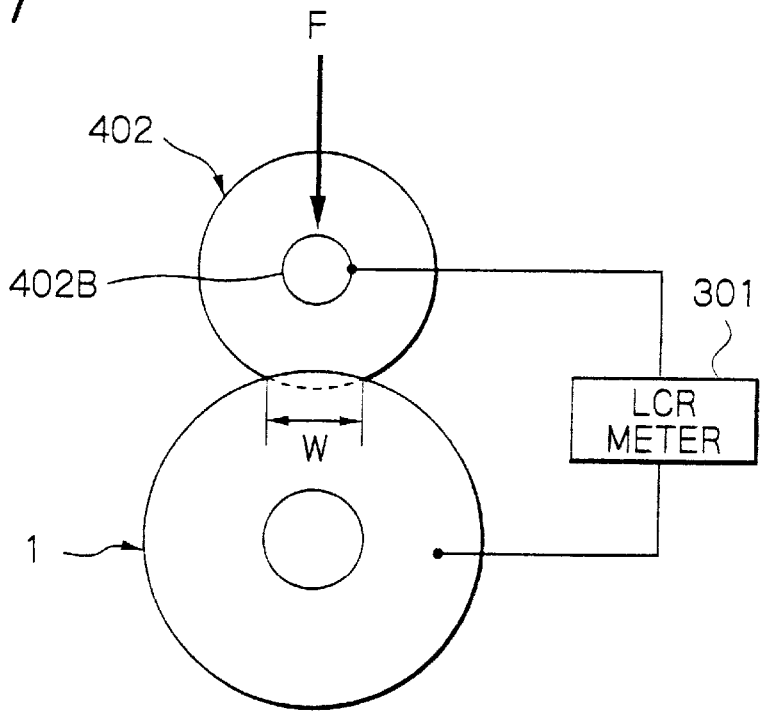
FIG. 11 is a side elevation of the system shown in FIG. 10.

To confine the capacities $C_D$ and C. and resistances $R_D$ and $R_P$ in the preferable ranges stated above, they may be determined by direct measurement. FIG. 10 and 11 show a specific system for measuring the capacities $C_D$ and $C_P$ and resistances $R_D$ and $R_P$. As shown, to measure the composite capacitance $C_T$ and composite. resistance $R_D+R_P$, the developing roller 402 with a toner layer is set on the drum 1 as during development. A weight F of 4.9 N (500 gf) is applied to opposite ends of the core or shaft 402B of the developing roller 402, i.e., a total weight F of 9.8 N (1 kgf) is applied. In this condition, the developing roller 402 and drum 1 form a nip having a width of W between them. A meter (LCR meter) 301 is connected between the core 402B of the developing roller 402 and the aluminum tube of the drum 1 so as to apply a preselected voltage. The preselected voltage may be a high-frequency voltage having a frequency of 100 kHz and an effective value of 0.01 Vrms. By reading a capacity in the C range, it is possible to measure the composite capacity $C_T$. Also, by reading a resistance in the R range, it is possible to measure the composite resistance $R_D+R_P$.

To measure the capacity $C_D$ and resistance $R_D$ individually, a conductive roller having the same radius as the drum 1 is pressed against the developing roller 402 carrying the toner layer thereon.

Materials capable of confining the capacities $C_D$ and $C_P$ and resistances $R_D$ and $R_P$ in the above-described ranges will be described specifically hereinafter. The elastic layer 402S*a* of the developing roller 402 may be formed of polyurethane, EPDM rubber, natural rubber, butyl rubber, nitrile rubber, NBR, epichlorohydrine rubber, polybutadien rubber, silicone rubber, styrene-butadiene rubber, ethylene-propylene rubber, chloroprene rubber, acrylic elastomer or a mixture thereof. A crosslinking agent and a vulcanizing agent may be added to the above material. More specifically, whether crosslinking maybe organic peroxide vulcanization or vulcanized crosslinking, use may be made of a vulcanization assisting agent, a vulcanization accelerator or a vulcanization decelerator. Further, a blowing agent, a plasticizer, a softening agent, a tackifier, a separating agent, a parting agent, a filler or a coloring agent may be added to the above material within a range that does not deteriorate the expected characteristics.

In the illustrative embodiment, the electric characteristics, particularly the resistance of the developing roller 402, are important. To control the resistance, use is made of a powdery, conductivity providing agent, e.g., acetylene black or similar conductive carbon, SAF, ISAF, HAF, FEF, GPF, FT, MT or similar carbon for rubber, oxidized or similar carbon for colors, thermally decomposed carbon, indium-doped tin oxide (ITO), tinoxide, titaniumoxide, zincoxide, copper, silver, germanium or similar metal or metal xoide, Polyanine, Polyprol, polyacetylene or similar conductive polymer. Alternatively, use may be made of an ion conductive substance, e.g., sodium perchlorate, rithium perchlorate, calcium perchlorate, rithium chloride or similar inorganic ion conductive material or denaturated fatty acid dimethylammonium ethosulfate, stearic acid ammonium acetate, laurylammonium acetate, octadecyl trimethylammonium perchlorate salt or similar organic, ion conductive substance.

In the illustrative embodiment, the elastic layer 402S*a* should preferably have a volume resistivity of $10^3$ Ω·cm to $10^9$ Ω·cm. A volume resistivity below $10^3$ Ω·cm would critically deteriorate the processing of the material and would increase hardness. On the other hand, a volume resistively above $10^9$ Ω·cm would make it difficult to provide the entire roller, which is coated with the surface protection layer 402S*b*, with the desired resistance.

While the hardness of the elastic layer 402S*a* is open to choice, it should preferably be 60° or below (JIS (Japanese Industrial Standards) A scale) in the case where the developing roller 402 and drum 1 contact each other. More preferably, the above hardness should be between 25° and 50°. If the elastic layer 402S*a* of the drum, which is a specific image carrier, is excessively high, then the nip width $W_D$ becomes too small to effect desirable development. The hardness of 50° or below successfully implements the desired nip width even if the developing roller 402 and drum 1 are pressed against each other by a pressure of 0.098 N/mm (=10 gf/mm) for a unit axial length. Particularly, when the elastic layer 402S*a* is formed of, e.g., a foam material, the effective hardness can be easily reduced to 20° or below. It is therefore possible to implement the required nip even with a pressure as low as about 0.049 N/mm (=5 gf/mm).

Conversely, if the hardness of the elastic layer 402S*a* is excessively low, then residual strain ascribable to compression increases and renders image density irregular when the developing roller 402 deforms or becomes eccentric. Moreover, a material with low hardness is limited because the physical property particular to the material has great influence at the low hardness side. The hardness should preferably be not reduced by more than 20%.

Specific configurations of the elastic layer 402S*a* will be described hereinafter. In a first specific configuration, polyol and isocyanate with carbon black dispersed therein form a 4 mm thick, elastic, urethane elastomer layer on a core or shaft, which is formed of SUS (chrome stainless steel) and has a diameter of 8 mm. Carbon black is dispersed such that the elastic layer has a volume resistivity of $1.7\times10^8$ Ω·cm and a hardness of 32°.

In a second specific configuration, a 4 mm thick, elastic epychlorohydrine rubber layer is formed on the same core as in the first specific configuration. Calcium carbonate, sulfur, a vulcanization accelerator and so forth are added to epichlorohydrine rubber in order to provide the elastic layer with a volume resistivity of $1.7\times10^8$ Ω·cm and a hardness of 47°.

A third specific configuration is identical with the first specific configuration except that the elastic layer has a volume resistivity of $2.6\times10^{10}$ Ω·cm and a hardness of 30°.

As for the surface protection layer 402S*b* of the developing roller 402, use may be made of any suitable material that does not contaminate the toner or the drum 1. However, the protection layer 402S*b* formed on the elastic layer 402S*a* must be soft and wear-resistant. Specifically, the protection layer r402S*b* may be formed of a copolymer of urethane resin, polyester resin, silicone resin or fluorocarbon or fluoroolefin and vinylether, allylether, vinylester or similar ethylenic unsaturated monomer. Various conductivity agents are added to such resins as in the case with the elastic layer 402S*a*. Further, a curing agent may be added in order to enhance resistance to toner and wear.

The surface protection layer 402S*b* should preferably be 30 μm thick. A thickness above 30 μm would make the protection layer 402S*b* harder than the elastic layer 402S*a* and would cause it to easily crack or crease or would deteriorate its creeping characteristic. To form the protection layer 402S*b* on the elastic layer 402S*a*, use may be made of dipping, spray coating, roll coating or similar coating method.

The following specific configurations of the surface protection layer 402S*b* are available. In a first specific configuration, fluorocarbon resin with carbon black dispersed therein is used. Carbon black is added by an amount of 3 wt % to 30 wt % with respect to fluorocarbon resin. In a second specific configuration, a conductive, urethane paint is coated on the elastic layer 402S*a*. In a third specific configuration, use is made of fluorine-containing resin that is a copolymer of fluoroolefin and an ethylenic unsaturated monomer (Lumiflon (trade name) available from Asahi Glass Co., Ltd.) and contains 50 wt % to 70 wt % of metal oxide (ITO).

The toner 10 is a mixture of polyester, polyol, styrene-acryl or similar resin, a charge control agent (CCA), and a coloring agent. Each grain of the toner 10 is coated with silica, titanium oxide or similar substance for enhancing fluidity. The grain size of the above substance generally lies in the range of from 0.1 μm to 1.5 μm As for the coloring agent, use maybe made of carbon black, Phthalocyanine Blue, quinacridone or carmine. Alternatively, the toner 10 may be implemented by mother grains with wax or similar substance dispersed therein and the above additive coating the mother grains.

The volume mean grain size of the toner 10 should preferably be between 3 μm and 12 μm. In the illustrative embodiment, the toner has a volume mean grain size of 7 μm and can adapt even to an image whose resolution is as high as 1200 dpi (dots per inch) or above. While the toner 10 is chargeable to negative polarity in the illustrative embodiment, it may be chargeable to positive polarity in accordance with polarity to which the drum 1 is chargeable.

To measure the grain size distribution and charge distribution of the toner 10, use was made of an analyzer E-SPART ANALYZER (trade name) available from HOSOKAWA MICRON CORP. This analyzer uses a double beam, frequency shift type of laser Doppler speedometer and an acoustic wave that causes the motion of particles to perturb in a static electric field. The analyzer blows off toner with air and determines the resulting motion of the toner in the electric field to thereby output data representative of the grain size and the amount of charge of the individual grain.

The magnetic grains 11 each have a core formed of metal or resin and containing ferrite or similar magnetic substance. Each carrier grain 11 is coated with, e.g., silicone resin. The grains 11 should preferably have a grain size of 20 μm to 50 μm and a dynamic resistance DR of $10^4$ Ω to $10^8$ Ω.

Figure 12:
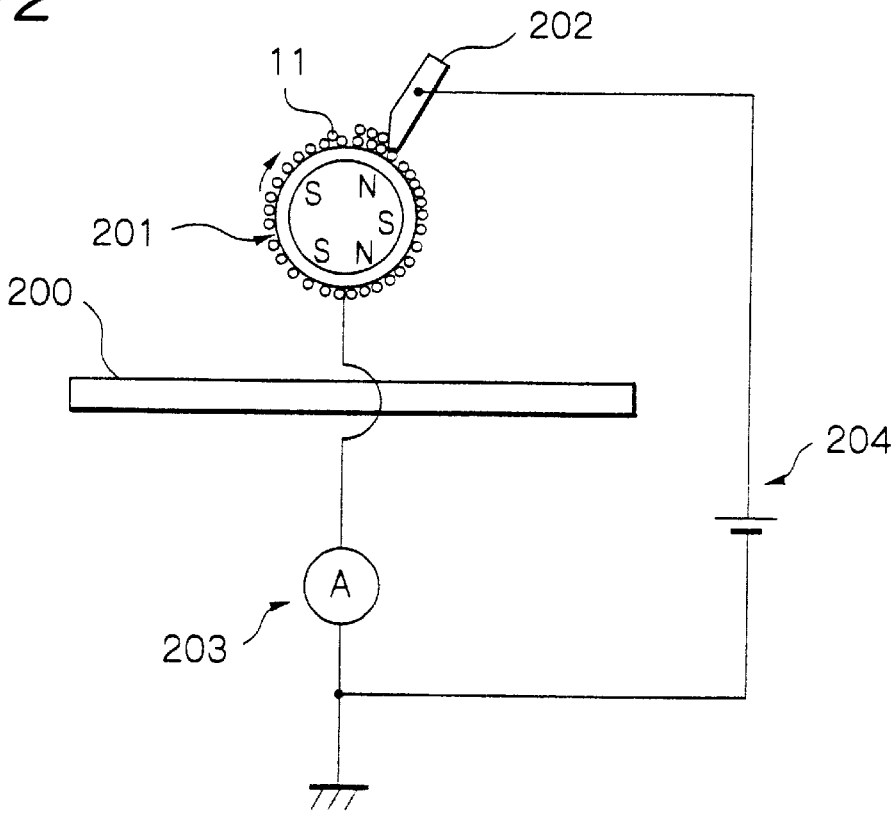
FIG. 12 is a view showing a specific arrangement for measuring the dynamic resistance of magnetic grains.

FIG. 12 shows a specific arrangement for measuring the dynamic resistance DR of the magnetic grains 11. As shown, a rotatable sleeve 201 having a diameter of 20 mm and accommodating a stationary magnet member therein is positioned above a base 200, which is connected to ground. An electrode (doctor blade) 202 faces the surface of the sleeve 201 with a gap g of 0.9 mm therebetween. The electrode 202 has a width W of 65 mm and a length L of 0.5 mm to 1 mm. In this condition, the sleeve 201 is caused to start rotating. The magnetic grains are deposited on the sleeve 201 in a preselected amount (14 g) and agitated for 10 minutes by the rotation of the sleeve 201.

While no voltage is applied to the sleeve 201, a current Ioff (A) flowing between the sleeve 201 and the electrode 202 is measured by an ammeter 203. Subsequently, a power supply 204 applies a voltage E (V) of the maximum withstanding voltage level to the sleeve 201 for 5 minutes. The above maximum withstanding level is 400 V in the case of high resistance, silicone-coated magnetic grains or several volts in the case of iron magnetic grains. In the illustrative embodiment, the above voltage E is selected to be 200 V. While the voltage E is being applied, a current Ion (A) flowing between the sleeve 201 and the electrode 200 is measured by the ammeter 203. By using the results of such measurement, the dynamic resistance DR (Ω) was calculated:

$$DR=E/(\text{Ion}-\text{Ioff}) \quad \text{Eq. (1)}$$

The illustrative embodiment will be described more specifically hereinafter. FIG. 13 lists major parameters particular to the illustrative embodiment. The system of FIG. 10 was used to measure a capacity between the conductive base 402B of the developing roller 402 and the conductive base 1B of the drum 1 under the conditions shown in FIG. 13. The capacity was measured to be 89 pF/cm$^2$. Subsequently, the drum 1 was replaced with a conductive roller in order to measure resistance (corresponding to RD) between the conductive roller and the conductive base 402B of the developing roller 402 by using the system of FIG. 10. The resistance was measured to be $4.0\times10^7$ Ω/cm$^2$. For such measurement, use was made of a high-frequency voltage having a frequency of 100 kHz and an effective value of 0.01 Vrms.

Images actually formed under the conditions listed in FIG. 13 were free from scattered toner therearound. That is, latent images were faithfully, stably developed without any background contamination and by a sufficient amount of toner.

While the illustrative embodiment has concentrated on negative-to-positive development (reversal development), the present invention is similarly applicable to positive-to-positive development (regular development).

The illustrative embodiment is applicable even to an intermediate image transfer type of image forming apparatus that transfers a toner image from a photoconductive drum to an intermediate image transfer body and then transfers it from the intermediate image transfer body to a recording medium, and a developing device for the same. This kind of image forming apparatus may be implemented as a color image forming apparatus constructed to sequentially form toner images of different colors on a single photoconductive drum, transfer the toner images to an intermediate image transfer belt one above the other, and then transfer the resulting composite toner image to a paper sheet. A tandem image forming apparatus to which the present invention is also applicable includes a plurality of image forming units each including a respective photoconductive drum and arranged side by side along an intermediate image transfer belt.

The present invention is, of course, applicable not only to the printer shown and described, but also to a copier, facsimile apparatus or similar image forming apparatus.

As stated above, the illustrative embodiment achieves various unprecedented advantages, as enumerated below.

(1) There can be realized low-potential development that reduces the electrostatic fatigue of a photoconductive element whose potential for development is 300 V or below in absolute value. Use is made of toner whose mean amount of charge Q/M is $5\times10^{-6}$ C/g or below in absolute value to thereby reduce background contamination. These in combination implement images having the target density of $0.5\times10^{-3}$ g/cm$^2$ or above.

(2) The capacity $C_D$ between the conductive base of the toner carrier and the photoconductive layer of the image carrier and the capacity $C_P$ of the photoconductive layer serially connected together constitute the composite capacity $C_T$. In the illustrative embodiment, the composite capacity $C_T$ lies in the particular range described earlier in order to reduce background contamination and implement desired image density.

(3) Smaller one of the capacities $C_D$ and $C_P$ lies in the above range, reducing background contamination and insured desirable image density.

(4) When there holds a relation of $R_D$<<and $R_P$ between the resistance $R_D$ between the conductive substance of the toner carrier and the photoconductive layer of the image carrier and the resistance $R_P$ of the photoconductive layer, the capacity $C_P$ lies in the above-described range. This also reduces background contamination and insures desirable image density.

(5) The linearly rising portion of the gamma characteristic has the maximum slope α lying in the previously mentioned range. This also reduces background contamination and insures desirable image density.

(6) Not only background contamination ascribable to short toner charge, but also short toner deposition ascribable to excessive toner charge are reduced.

(7) Development is substantially completed within the period of time $T_D$, surely depositing a preselected amount of toner.

(8) Leak current between the conductive base of the toner carrier and the photoconductive layer of the image carrier is reduced to insure stable development. Moreover, assume that the potential for development is 300 V or below in absolute value, and that the nip for development is 1 mm wide or more in the direction of movement of the surface of the image carrier. Then, background contamination is reduced to insure desirable image density even if the surface of the image carrier moves at the velocity as high as 500 mm/sec.

(9) The nip of preselected width can be surely formed while the function of charging the toner to preselected polarity and the function of preventing the toner from sticking can be assigned to the toner carrier.

(10) When the process unit of the illustrative embodiment is removably mounted to the apparatus body, discharge between the conductive base of the toner carrier and the photoconductive layer of the image carrier and therefore the electrostatic fatigue of the photoconductive layer is reduced. In addition, toner whose mean amount of charge Q/M is $5\times10^{-6}$ C/g or above can deposit on the image portion of the photoconductive layer in the amount M/A of $0.5\times10^{-3}$ g/cm$^2$ or above.

Figure 14:
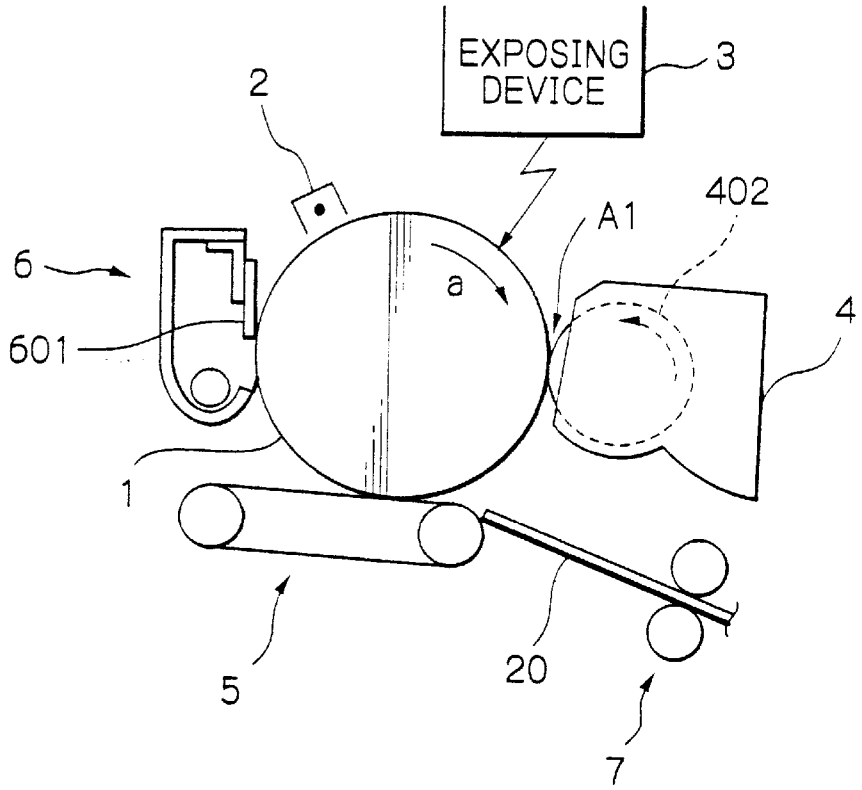
FIG. 14 is a view showing an alternative embodiment of the image forming apparatus in accordance with the present invention.
Figure 15:
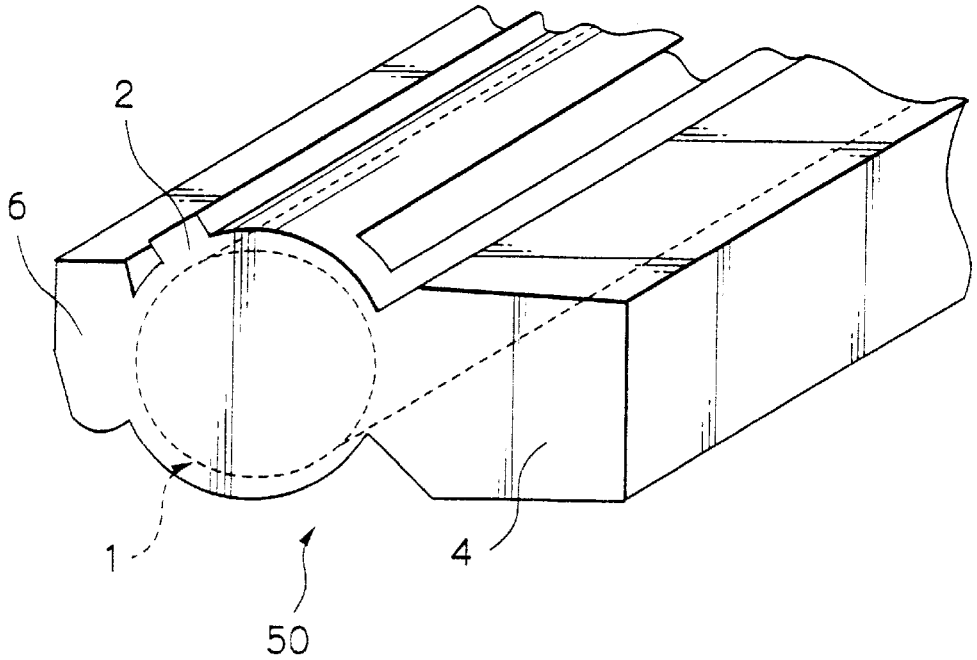
FIG. 15 is an isometric view showing a process unit included in the embodiment of FIG. 14.

An alternative embodiment of the present invention mainly directed toward the second object stated earlier will be described hereinafter. The illustrative embodiment is also implemented as an electrophotographic laser printer. FIG. 14 shows the general construction of the printer while FIG. 15 shows a process unit included in the apparatus. These printer and process unit are identical with the printer and process unit of the previous embodiment except for the configuration of the developing unit 4.

Figure 16:
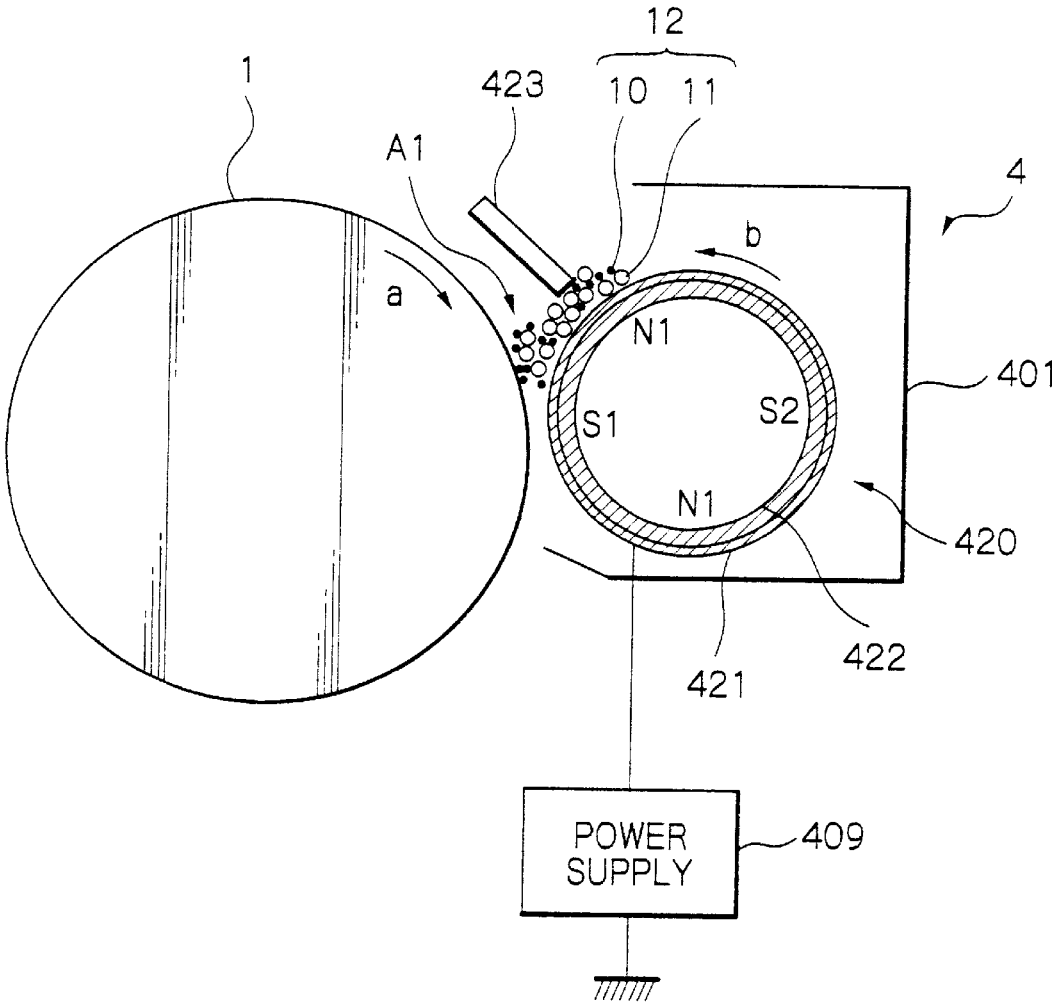
FIG. 16 is a view showing a developing device included in the embodiment of FIG. 14.

As shown in FIG. 16, the developing unit 4 of the illustrative embodiment includes a casing 401 accommodating a developing roller 420. The developing roller 420 is partly exposed to the outside via an opening formed in the casing 401 and facing the drum 1. Agitating/conveying means, not shown, is disposed in the casing 401 for agitating the toner 10 and carrier 11, i.e., the developer 12 while conveying it. Part of the developer 20 deposits on the developing roller 420. The developing roller 420 conveys the developer 20 toward the developing position A1 while a doctor blade 423 regulates the amount of the developer 12, as in the previous embodiment. Part of the developer 12 removed from the developing roller 420 by the doctor blade 423 is returned to the casing 401. At the developing position A1, the toner 10 of the developer 12 is transferred from the developing roller 420 to the drum 1, developing a latent image formed on the drum 1.

The developing roller 420 is made up of a stationary magnet member 422 having a plurality of magnetic poles and a nonmagnetic, rotatable sleeve 421. The magnetic member 422 exerts a magnetic force when the developer 12 passes preselected positions on the sleeve 421. The developing roller 420 should preferably have a diameter of 10 mm to 30 mm (18 mm in the illustrative embodiment). The surface of the developing roller 420 is roughened by sand blasting or formed with a plurality grooves that are 1 mm to several millimeters deep. The resulting surface of the developing roller 420 should preferably have a surface roughness between 10 $\mu$m and 20 $\mu$m.

A driveline, not shown, causes the sleeve 421 of the developing roller 420 to rotate in a direction b shown in FIG. 16. A power supply 409 applies a bias $V_B$. for development to the developing roller 420 at the developing position A.

The magnet member 422 has an N pole (N1), an S pole (S1), an N pole (N2) and an S pole (S2) as named in the direction of rotation of the sleeve 421 from the position where the doctor blade 423 meters the developer layer. Of course, such an arrangement of magnetic poles is only illustrative and may be modified in matching relation to the position of, e.g., the doctor blade 423 around the developing roller 420. Also, an arrangement may be made such that the magnet member 422 rotates relative to the sleeve 421 held stationary.

Again, the developer 12 made up of the toner 10 and magnetic grains 11 forms a brush on the sleeve 421 due to the magnetic force of the magnet member 422. The toner 10 present in the magnet brush formed on the sleeve 421 is charged by a preselected amount by being mixed with the magnetic grains 11. The amount of charge to deposit on the toner should preferably be between −5 $\mu$C/g to −35 $\mu$C/g.

In the illustrative embodiment, too, an imaginary line connecting the pole N1 of the magnet member 422 and the axis of the magnet member 422 is inclined relative to an imaginary line connecting the doctor blade 406 and the above axis-toward the upstream side in the direction of rotation of the roller 420. This allows the developer 12 to be easily circulated in the casing 401. The angle of inclination of the pole N1 may advantageously be between 0° and 15°.

The toner 10 is identical with the toner of the previous embodiment as to the composition, producing method, volume means grain size. The grain size and charge distribution of the toner 10 were measured in exactly the same manner as in the previous embodiment. Further, the magnetic grains 11 are also identical with the magnetic grains 11 of the previous embodiment as to grain size, resistance, and dynamic resistance DR.

The drum 1 also has the configuration described with reference to FIG. 4. The drum 1 may be replaced with a belt made up of a relatively thin base formed of, e.g., polyethylene terephthalate (PET), polyethylene naphthalate (PEN) or nickel and a photoconductive layer formed on the base. While the illustrative embodiment charges the drum 1 to negative polarity, use may be made of a drum chargeable to positive polarity, as needed.

Figure 17:
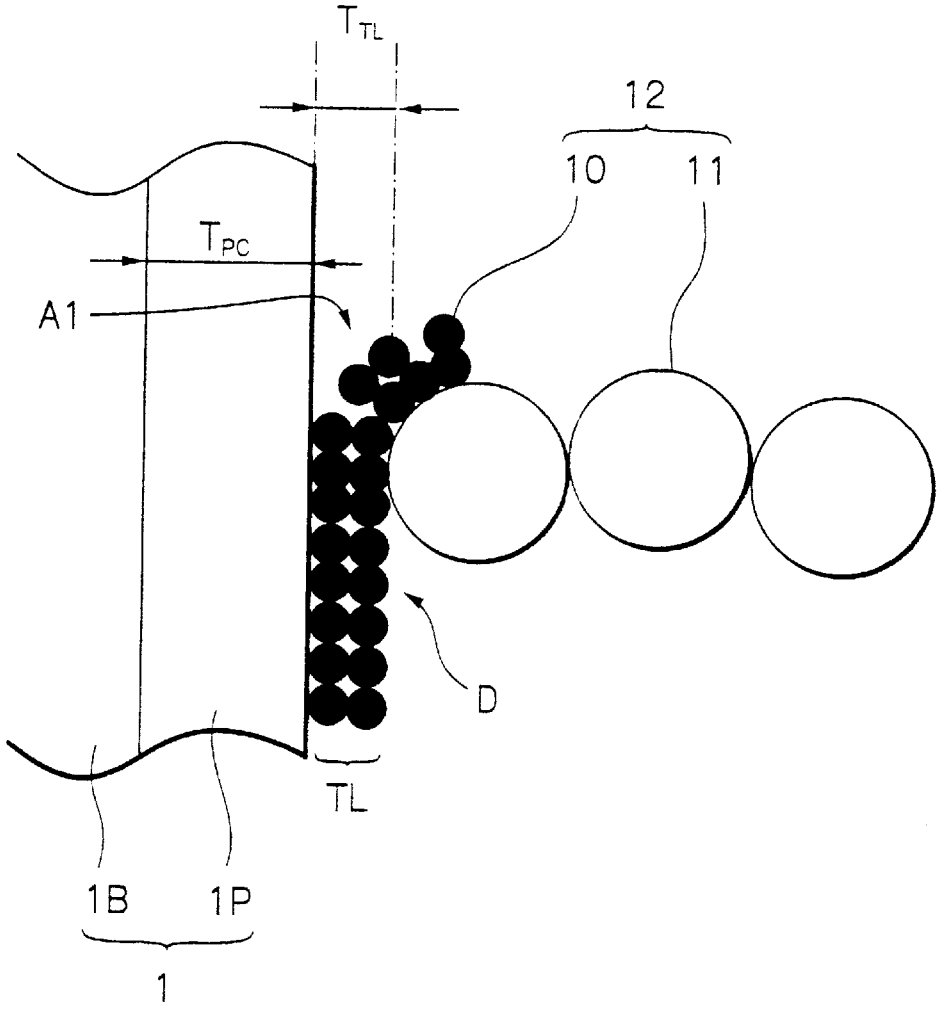
FIG. 17 is a sketch showing toner grains and magnetic grains existing at a developing position in the embodiment of FIG. 14.

FIG. 17 is a sketch showing the toner grains 10 and magnetic grains 11 observed at the developing position A1. Assume that a region adjoining the drum 1 and where the toner grains contributing to development are present has a capacity of $C_{TL}$ for a unit area, and that the photoconductive layer 1P of the drum 1 has a capacity of $C_{PC}$ for a unit area. Then, in the illustrative embodiment, the material and thickness of the photoconductive layer 1P and the material of the toner 10 are selected such that the capacity $C_{TL}$ is greater than the capacity $C_{PC}$.

In the illustrative embodiment, the magnetic grains 11 have a dynamic resistance as low as $10^7$ Ω. Therefore, the region where the toner gains contributing to development exist corresponds to a toner layer D between the tip of the magnetic grain on the developing roller 420 and the surface of the drum 1.

In a specific example of the illustrative embodiment, the photoconductive layer 1P of the drum 1 had a specific inductive capacity of 2.7, a thickness $T_{PC}$ of 30 $\mu$m, and a capacity of 79.6 pF/cm$^2$ for a unit area. The toner layer TL adjoining the surface of the drum 1 had a specific inductive capacity of 2.7 and a thickness of 15 $\mu$m, as measured at the developing position A1. The capacity $C_{TL}$ of the toner layer TL is therefore 177 pF/cm$^2$ that satisfies the relation of $C_{PC}<C_{TL}$. Under this condition, solid images and line images were formed. Parameters listed in FIG. 18 are also used for experiments. For comparison, similar images were formed with a photoconductive layer 1P having a capacity of 119 pF/cm$^2$for a unit area (specific inductive capacity of 2.7 and thickness $T_{PC}$ of 20 $\mu$m) and a toner layer TL having a capacity $C_{TL}$ of 106 pF/cm$^2$ (specific inductive capacity of 3 and thickness $C_{TL}$ of 25 $\mu$m). For the comparative example, the capacity $C_{PC}$ was selected to be greater than the capacity $C_{TL}$.

Figure 19:
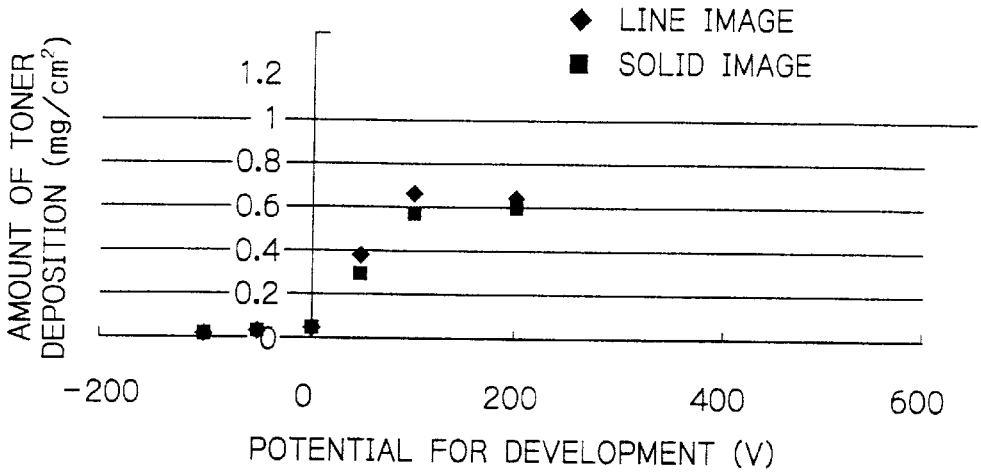
FIG. 19 is a graph comparing a line image and a solid image with respect to a gamma characteristic available with the illustrative embodiment.
Figure 20:
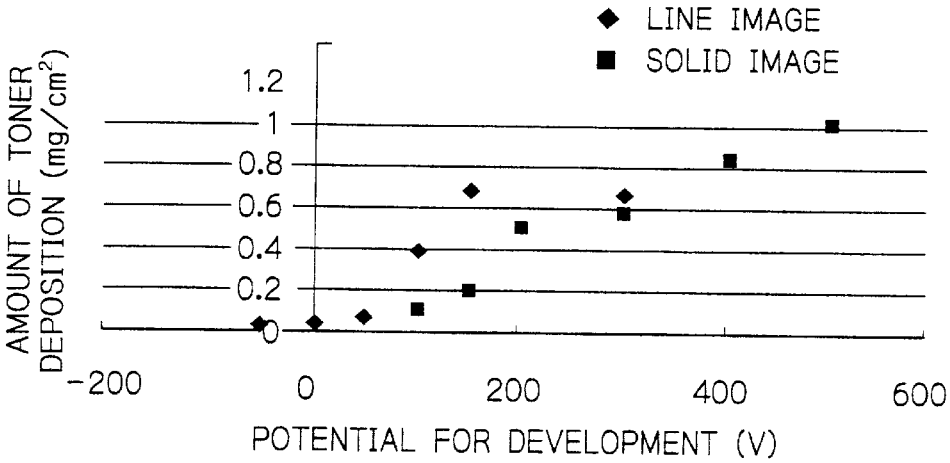
FIG. 20 is a graph comparing a line image and a solid image with respect to a gamma characteristic determined with a comparative example.

FIG. 19 shows gamma curves representative of a relation between the amount of toner deposition and the potential for development each and determined with the example of the illustrative embodiment. As shown, the curves, which were respectively determined with a line image and a solid image, are almost identical as to the slope of the rising portion and saturation potential. This proves that a density difference between a solid image and a line image (dot image) is reduced. By contrast, as shown in FIG. 20, the gamma curves relating to the comparative example and determined with a solid image and a line image differ from each other. This means that a noticeable density difference occurs between a solid image and a line image (dot image) even when the potential for development is the same.

Figure 21:
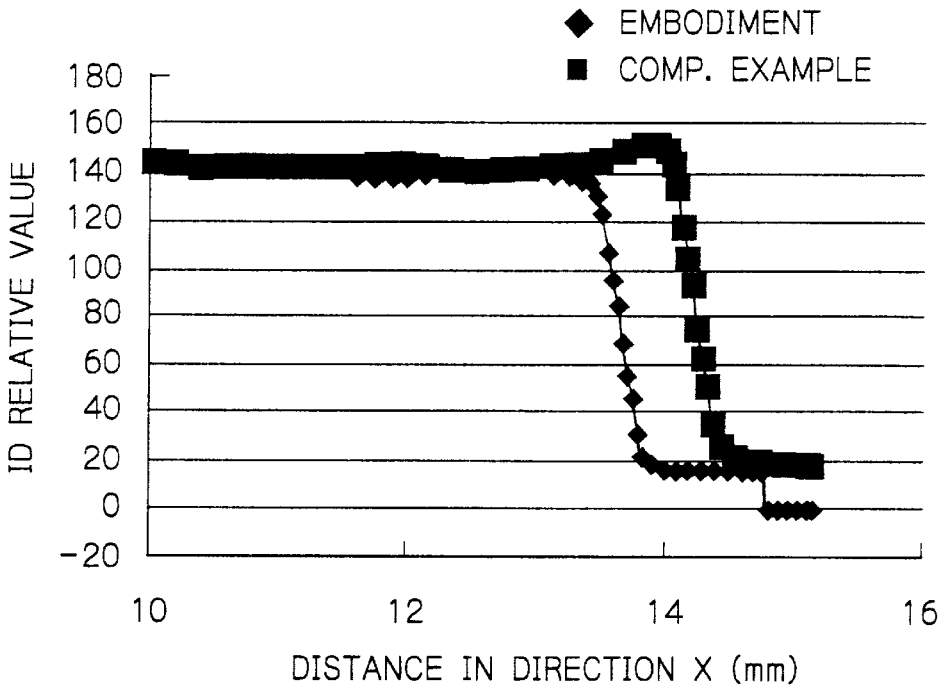
FIG. 21 is a graph comparing the illustrative embodiment and comparative example with respect to the variation of image density around the edge of a solid image.

FIG. 21 compares the example of the illustrative embodiment and comparative example as to density variation at the edge of a solid image. As shown, the edge effect is noticeable in the comparative example, but is negligible in the example of the illustrative embodiment. This also shows that the example of the illustrative embodiment reduces a density difference between a solid image and a line image (dot image).

Figure 22:
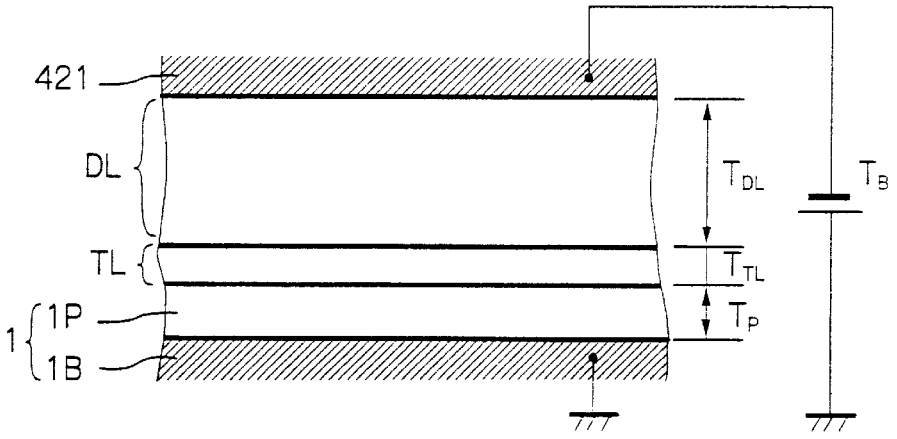
FIG. 22 shows a model used for simulation.

To determine a relation between the relation in size between the capacities $C_{TL}$ and $C_{PC}$ and the size of the edge effect, simulation was conducted with a bidimensional model by use of a computer. FIG. 22 shows a specific model used for the simulation. As shown, a developer layer $D_L$ made up of toner and magnetic grains was formed on the sleeve 421 and had a specific inductive capacity $T_{DL}$ of 10 and a thickness $T_D$ of 325 $\mu$m. A toner layer $T_L$ adjoining the photoconductive layer 1P had a specific inductive capacity of 3 while the layer 1P had a specific inductive capacity of 2.7. The layer 1P had a potential $V_L$ of −450 V in its background and a potential $V_L$ of −150 V in its image portion. The bias for development $V_B$ was selected to be −250 V.

Figures 23, 24:
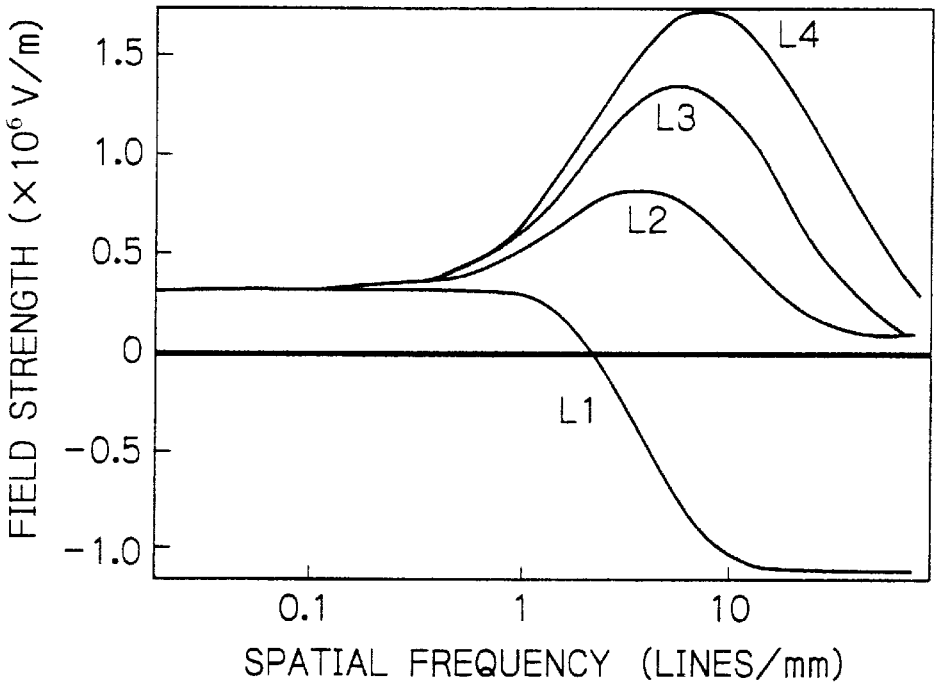
FIG. 23 is a graph showing a relation between the spatial frequency of a line image and the strength of an electric field determined by simulation.
FIG. 24 is a table listing parameters calculated by varying the thickness of a photoconductive layer and that of a toner layer.

FIG. 23 plots the strengths of an electric field (V/m) perpendicular to the surface of the photoconductive layer P1 in relation to the spatial frequency of a line image (lines/mm). Electric fields that attract the toner toward the surface of the photoconductive layer P1 are positioned at the positive side. Curves L1, L2, L3 and L4 are respectively representative of field strengths measured at the distances of 50 $\mu$m, 20 $\mu$m, 10 $\mu$m and 5 $\mu$m from the surface of the photoconductive layer 1P at the center of a line image. Assume that the field strength at the distance of 20 $\mu$m has a peak value of Ep, and that the field strength at a position where the spatial frequency is 0.1/mm has a value of Esol. Then, in FIG. 23, a value Ep/Esol is used as a parameter representative of the intensity of the edge effect.

Figures 25, 26:
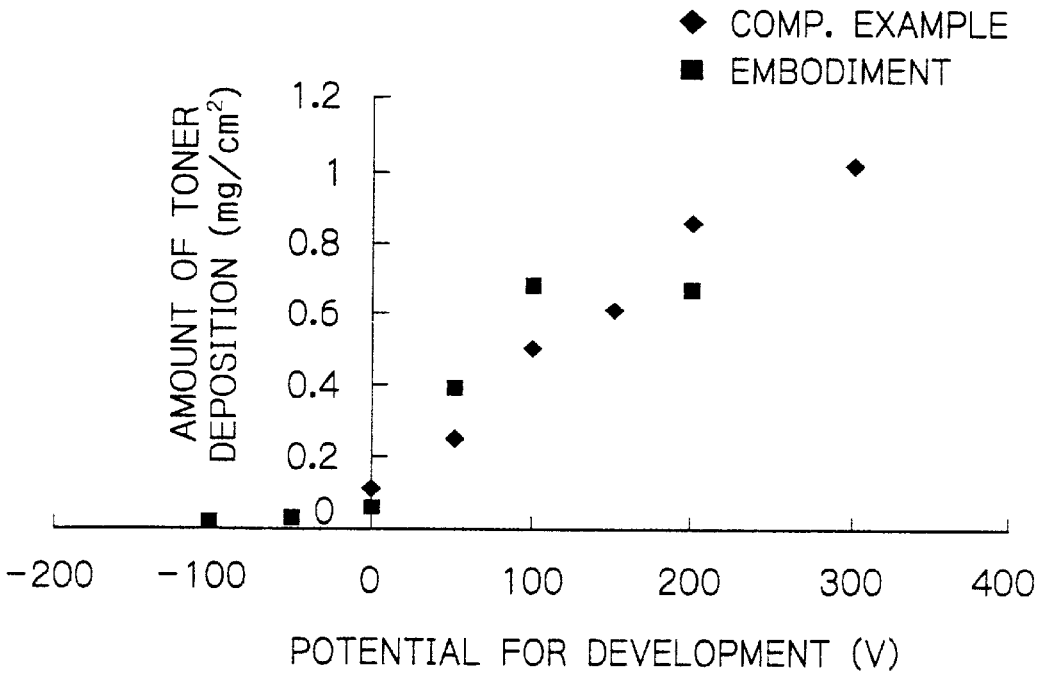
FIG. 25 is a table showing a relation between the parameters, edge effect ranks and the results of evaluation by eye.
FIG. 26 is a graph comparing the illustrative embodiment And comparative example with respect to a gamma characteristic.

FIG. 24 lists the values of the parameter Eop/Esol calculated by varying the thickness of the photoconductive layer 1P and that of the toner layer TL. FIG. 25 shows a relation between the values of the parameter Ep/Esol and edge effect ranks determined by experimental image formation conducted under the same conditions, and the results of evaluation by eye.

As FIGS. 24 and 25 indicate, when the capacity $C_{TL}$ of the toner layer is greater than the capacity $C_{PC}$ of the photoconductive layer 1P, the edge effect can be suppressed to such a degree that the thickening of fine lines and small dots is not observed by eye.

It has been customary with an image forming apparatus to deposit a relatively high potential of −500 V on a photoconductive drum. By contrast, in the illustrative embodiment, the drum 1. is uniformly charged to the potential $V_O$ of −250 V and then charged to the potential $V_L$ of −50 V by exposure (image portion). In addition, the bias for development is −150 V. The illustrative embodiment can therefore effect sufficient development with a potential for development that is as low as 100 V. Low-potential development effected under the conventional conditions would lower the amount of development. To enhance the developing ability, the illustrative embodiment reduces the dynamic resistance of the magnetic grains 11 to $10^7$ Ω or below and confines the amount of charge to deposit on the toner in the range of from −10 $\mu$C/g to −20 $\mu$C/g. FIG. 26 compares the developing ability of the illustrative embodiment and that of the conventional developing device in terms of a gamma curve. As shown, the slope of the rising portion of the gamma curve is relatively small in the conventional device, but is great in the illustrative embodiment, meaning a decrease in saturation potential for development.

The maximum charge Vmax to be deposited on the drum 1 depends on the thickness $T_{PC}$ of the photoconductive layer 1P. Further, in practice, the charge leaks due to defects formed during the formation of the layer 1P. In the illustrative embodiment, while the layer 1P is 10 $\mu$m to 40 $\mu$m thick, the maximum charge Vmax is about 650 V for a thickness of 15 $\mu$m or about 1300 V for a thickness of 30 $\mu$m. It is preferable to select a charge potential that is one-half of the maximum charge Vmax or less for each thickness. For example, it is preferable to select a charge potential of about 390 V or below for a 15 $\mu$m thick layer or a charge potential lower than about 780 V for a 30 $\mu$m thick layer. When the amount of charge to deposit on the drum 1, not to speak of the amount of development, increases, the difference between the background potential and the bias for development increases and is likely to bring about background contamination.

The toner in the casing of the developing device has a charge distribution based on a certain grain size distribution. The toner 10 therefore contains undesirable grains charged to polarity opposite to preselected polarity. Such undesirable grains deposit on the background due to the difference between the background potential and the bias for development, contaminating the background. Let this difference be referred to as a background potential $V_{BG}$ hereinafter. For example, assume that the photoconductive layer 1P is 15 $\mu$m thick, that the charge potentials $V_O$ and $V_L$ to sequentially deposit on the layer 1P are −390 V and −100 V, respectively, and that the potential for development is 100 V. Then, the bias for development $V_B$ is −200 V, and therefore the background potential $V_{BG}$ ($=V_B-V_O$) is 190 V. In this case, the background contamination rank is "3". On the other hand, when the charge potentials $V_O$ and $V_L$ are −430 V and −100 V, respectively, and when the potential for development is 100 V, the bias V. for development is −230 V, and therefore the background potential $V_{BG}$ is 230 V. This lowers the background contamination rank to "2".

The absolute value $|V_O|$ of the charge potential $V_O$ should preferably be 300 V or below. An absolute value above 300 V is likely to bring about discharge due to the Paschen's law. An absolute value around 400 V is likely to result in discharge in the event of parting. Particularly, when the drum 1 is charged to, e.g., −500 V, black spots or similar defects appear when a current flows from the drum 1 to the developing roller 420. The absolute value of 300 V or below obviates the above defects and moreover makes it needless to apply an excessive voltage to the charger.

In the illustrative embodiment, the optical writing unit should preferably be controlled such that an identical latent image electric field is available for both of a line image and a solid image. For example, the quantity of light may be increased to increase a margin. While the illustrative embodiment causes the optics to emit a quantity of light of 0.23 mW, the quantity of light may be almost doubled to 0.47 mW in order to enhance the sensitivity of a latent image to development. A conventional, large beam diameter (e.g. 70×80$\mu$m) would increase the size of dots and therefore the area of an image and would thereby cause resolution to be lost. By reducing the beam diameter while increasing the quantity of light, it is possible to form an image without resolution being lost. Further, even if toner is left on the drum after image transfer, such a large quantity of light is transmitted through or turns round the toner, insuring a sufficient light attenuation characteristic. In this connection, assume that the photoconductive layer 1P is 15 $\mu$m thick, and that the charge potential is −500 V. Then, as for images formed on the second and successive paper sheets, the exposure power of 0.23 mW, as measured on the drum surface, caused the background to be contaminated. However, the exposure power of 0.47 mW implemented uniform images free from background contamination.

To bring the gamma characteristic of a line image and that of a solid image close to each other, differential sensitivity will be discussed as one of characteristic values. Assume that a light beam equivalent in wavelength to the light beam to issue from the exposing device 3 uniformly exposes the drum 1. Then, differential sensitivity S is defined as a relation between the resulting surface potential V(E) of the drum 1 and the amount of exposure E. More specifically, assume that the amount of exposure of the drum 1 is E, and that an amount of exposure slightly increased from E by ΔE deposits a potential of V(E+ΔE) on the drum surface. Then, the differential sensitivity S is expressed as:

$$S=|V(E+E)-V(E)| \quad \text{Eq. (2)}$$

Generally, the differential sensitivity S decreases with an increase in the amount of exposure E. A value that sufficiently reduces the differential sensitivity S refers to an amount of exposure that allows the range of the attenuation characteristic of the drum 1, which suffices for implementing desired stability, to be used. The desired stability, in turn, refers to the fact that in a bilevel process for rendering the tonality of an image in terms of the density of toner deposition pixels for a unit area, a plurality of dots can be formed with the same dot diameter and the same development density, which do not noticeably vary with the elapse of time. Development density, however, sometimes becomes short due to the rise of the potential after exposure ascribable to the aging of the drum 1. In this sense, a value that sufficiently reduces the differential sensitivity S refers to the amount of exposure capable of implementing a potential after exposure that obviates the above occurrence. For example, the differential sensitivity S of the photoconductive layer P1 may be reduced to one-third of the maximum value or below. Also, from the developing condition standpoint, it is desirable to develop the latent image of the drum 1 to saturation in order to form a plurality of dots with the same dot diameter and the same density by the bilevel process.

As shown in FIG. 4, the photoconductive layer 1P of the drum 1 is made up of the charge generation layer 1P*a* and charge transport layer 1P*b*. The entire layer 1P is 13 μm thick. In the illustrative embodiment, the thickness TP of the layer 1P and the beam diameter Db satisfy the following relation:

$$2TP<Db<8TP \quad \text{Eq. (3)}$$

Assume coordinates (x,y) on the surface of the drum 1. Then, an exposure amount distribution E(x,y) ($J/m^2$) is defined as a value produced by integrating the energy distribution P(x,y,t) ($W/m^2$) of the light beam on the drum 1 by the duration of exposure:

$$E(x,y)=\int P(x,y,t)dt \quad \text{Eq. (4)}$$

In this case, the beam diameter Db is defined as the minimum diameter corresponding to an amount of exposure that is $1/e^2$ of the peak of the distribution E(x,y).

Figure 27:
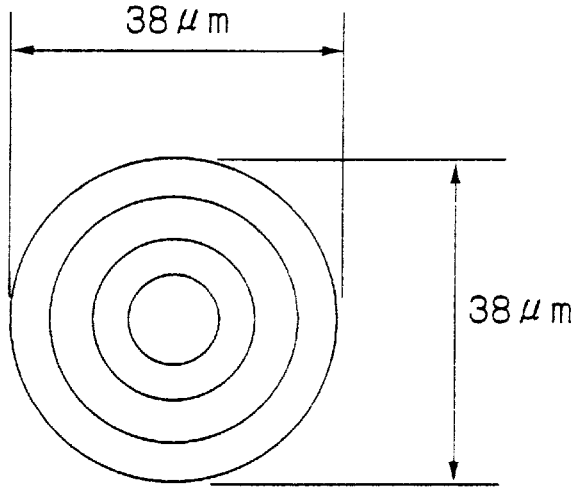
FIG. 27 shows a light quantity distribution measured on the surface of a photoconductive drum.

FIG. 27 shows an exposure amount distribution on the drum 1 by using contours. Assume that the illustrative embodiment exposes the drum 1 over about 20 μm in the subscanning direction in order to form one pixel of latent image. Then, as shown in FIG. 27, the beam diameter in the above distribution is about 30 μm in both of the main and subscanning directions. That is, the light beam has a Gauss distribution of approximately 30 μm in both of the main and subscanning directions. It follows that the exposure diameter Db of the light beam defined as the minimum value at $1/e^2$ of the peak is 38 μm.

Figure 28:
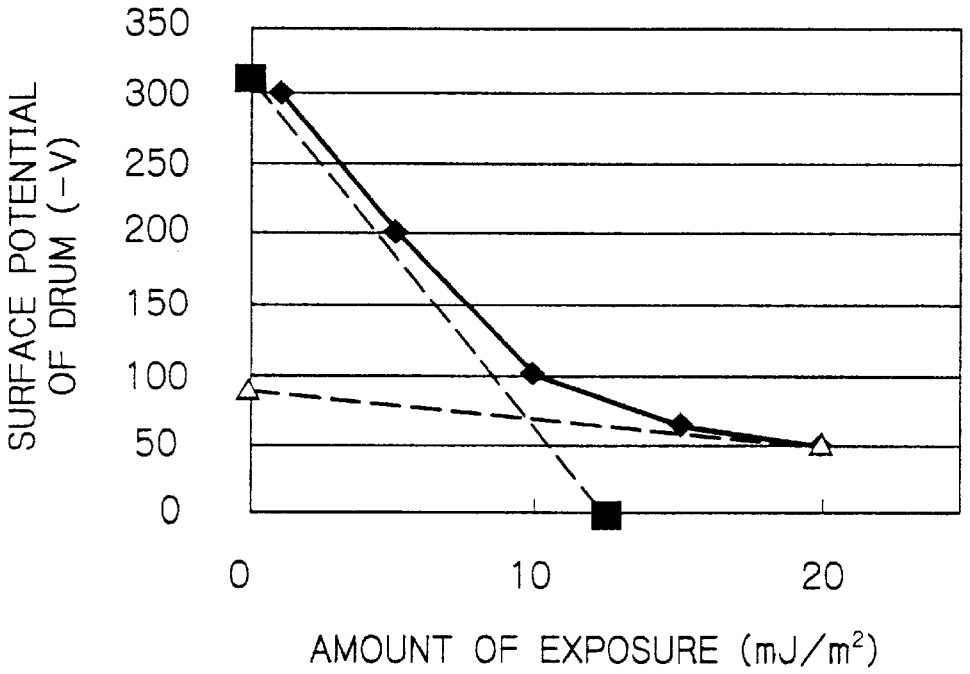
FIG. 28 is a graph showing a relation between the quantity of light for exposure and the surface potential of the drum.

FIG. 28 shows the attenuation characteristic of the surface potential of the drum 1 measured by varying the amount of exposure. In FIG. 28, rhombs indicates data determined by measurement. Square, circles and dashed lines connecting them will be used to describe differential sensitivity. In the illustrative embodiment, the exposing device 3 emits a light beam having a wavelength of 670 nm and exposure power of 0.23 mW, as measured on the surface of the drum 1. Therefore, the amount of exposure corresponding to the peak of the exposure amount distribution, i.e., in the exposure diameter Db can sufficiently reduce the differential sensitivity of the photoconductive layer 1P.

In the attenuation characteristic shown in FIG. 28, the maximum differential sensitivity is 28 $V\cdot m^2/mJ$. The amount of exposure E corresponding to differential sensitivity S that is one-third of the above maximum sensitivity or below can sufficiently reduce the differential sensitivity. In this connection, in FIG. 28, the amount of exposure E corresponding to the peak of the exposure amount distribution is 20 $mJ/m^2$, and the differential sensitivity S corresponding to E is 5 $V\cdot m^2/mJ$, which is about one-fifth of the maximum differential sensitivity.

Figures 29, 30:
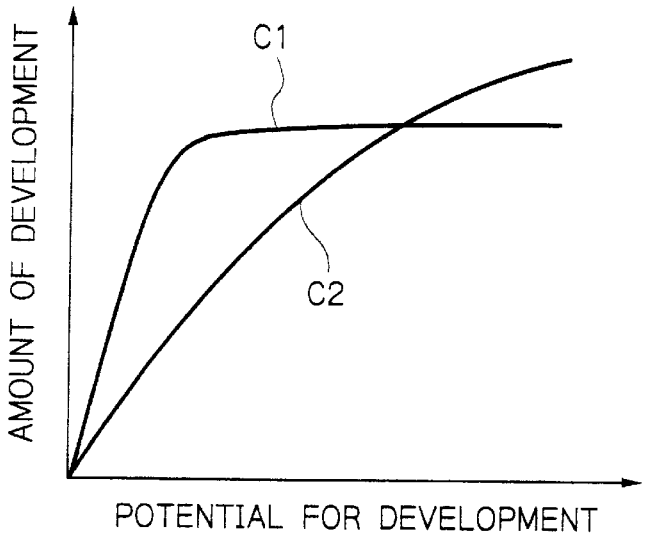
FIG. 29 is a graph for describing the gamma characteristic.
FIG. 30 is a table comparing the illustrative embodiment and comparative example with respect to the amount of charge.

FIG. 29 shows curves C1 and C2 respectively representative of the gamma characteristic of the illustrative embodiment and that of a comparative example or conventional developing device. As shown, the curve C1 sharply rises and shows that development can be effected even with a relatively low potential and immediately reaches saturation. Assume that use is made of the developing roller having the characteristic represented by the curve C1, and that the amount of toner to deposit on the roller 402 is maintained constant. Then, it is relatively easy to use the entire toner present on the roller 402 for development. However, when it comes to small dots, the conventional drum and writing conditions are apt to cause the amount of development and therefore dot diameter to vary if unable to sufficiently lower the differential sensitivity. The illustrative embodiment is free from this problem because of the sufficiently low differential sensitivity.

While the life of the drum 1 decreases due to sensitivity that falls in dependence on the amount of charge at the time of current supply. The illustrative embodiment operable with a low potential for development can lower the initial amount of charge. The illustrative embodiment implements an amount of charge shown in FIG. 30 at the time of current supply although it is dependent on the thickness of the photoconductive layer 1P. As shown in FIG. 30, the illustrative embodiment reduces the amount of charge to 1/1.45 of the amount of charge particular to a comparative example, thereby extending the life of the drum 1 by 1.45 times. Experiments showed that the illustrative embodiment maintained sensitivity satisfactory even when about 300,000 paper sheets of size A3 were passed while the comparative example lowered it when 200,000 paper sheets were passed.

Figure 31:
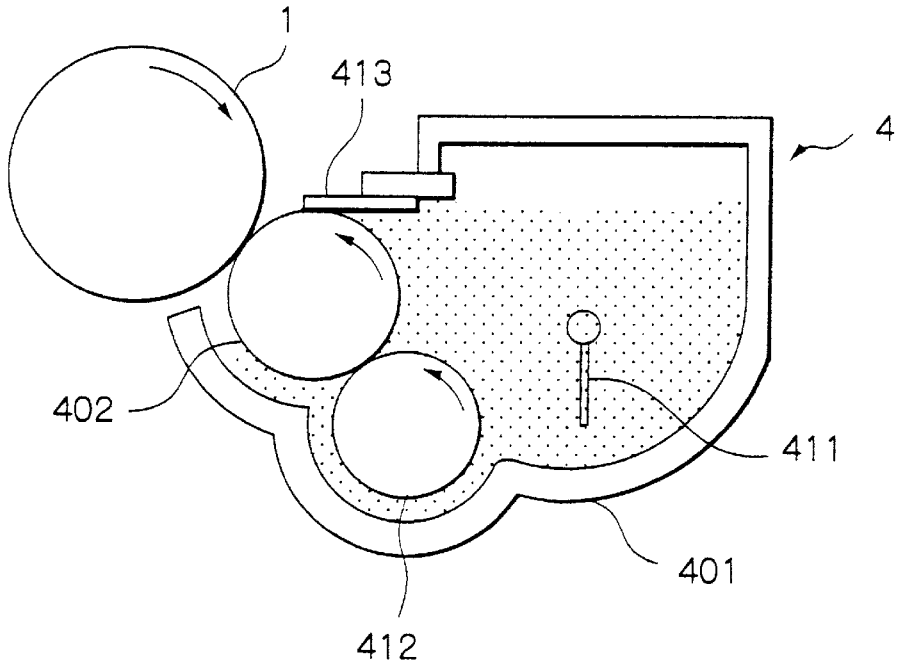
FIG. 31 is a view showing a developing device representative of another alternative embodiment of the present invention.

Referring to FIG. 31, another alternative embodiment of the present invention is shown and also mainly directed toward the second object stated earlier. This embodiment is identical with the preceding embodiment as to the construction and operation of the entire printer as well as to the formation of a latent image. In the illustrative embodiment, the developing device 4 stores a single-ingredient type developer, i.e., toner. As shown, the developing device 4 includes a developing roller 402 and conveys the toner deposited thereon in the form of a layer to the position where the roller 402 faces the drum 1.

More specifically, the developing device 4 includes a casing 401 storing the toner 10. An agitator 411 is disposed in the casing 401 and rotated to agitate the toner while mechanically conveying it to an elastic feed roller 412. The feed roller 412 is formed of, e.g., foam polyurethane and includes cells having a diameter of 50 μm to 500 μm each. With such cells, the feed roller 412 easily retains the toner thereon. The feed roller 412 has a relatively low hardness of 10° to 30° (JIS-A scale) and can evenly contact the developing roller 402.

The feed roller 412 is rotated in the same direction as the developing roller 402, so that the surfaces of the rollers 412 and 402 facing each other move in opposite directions to each other. The ratio of the linear velocity of the feed roller 412 to that of the developing roller 1 should preferably be between 0.5 and 1.5. The feed roller 412 may be rotated in the opposite direction to the developing roller 402, if desired. In the illustrative embodiment, the feed roller 412 is rotated in the same direction as the developing roller 402 with a linear velocity ratio of 0.9. The feed roller 412 bites into the 1 developing roller 402 by 0.5 mm to 1.5 mm. The amount of bite is dependent on the charging characteristic and feed of the toner and should therefore be optimally set in a broader range. Further, the amount of bite depends even on the characteristic of a motor and that of a gear head and should therefore be selected in consideration of the entire driveline. In the illustrative embodiment, when the effective unit width is 240 mm (A4 profile), a required torque is 14.7 N·cm to 24.5 N·cm (1.5 kgf cm to 2.5 kgf·cm)

The toner, like the toner of the preceding embodiment, consists of polyester, polyol, styrene-acryl resin or similar resin, charge control agent (CCA) and coloring agent and is coated with silica, titanium oxide or similar substance. While toner generally has a grain size ranging from 3 $\mu$m to 12 $\mu$m, the illustrative embodiment uses toner having a grain size of 6 $\mu$m.

The developing roller 402 is made up of a conductive base and a surface layer implemented by rubber. The developing roller 402 has a diameter of 10 mm to 30 mm and has its surface suitably roughened to a roughness RZ of 1 $\mu$m to 4 $\mu$m. This surface roughness is amount 13% to 80% of the grain size of the toner and allows the toner to be conveyed without being buried in the surface of the developing roller 402. Rubber applicable to the developing roller 402 may be silicone rubber, butadien rubber, NBR, hydrine rubber or EPDM. The surface of the developing roller 402 may advantageously be coated with a substance that maintains quality stable against aging. Such a coating material should advantageously be selected from silicone-based substances and Teflon-based substances, which are desirable as to toner charging and parting, respectively. The coating material may contain carbon black or similar conductive substance for providing conductivity, as the case may be. The coating layer should preferably be 5 m to 50 m thick. Thickness above 50 m is likely to cause the coating layer to crack. While the hardness of the developing roller 402 is low and the hardness of the drum 1 is high in the illustrative embodiment, the former may be high and the latter may be low, if desired.

The feed roller 412 conveys the toner of preselected polarity (negative polarity in the illustrative embodiment) to the position where the roller 412 faces the developing roller 402. As a result, the toner is frictionally charged to negative polarity by friction and deposited on the developing roller 402 by an electrostatic force and the surface roughness of the roller 402. At this stage, however, the toner layer deposited on the developing roller 402 is not uniform, but is excessive in amount (1 mg/cm$^2$ to 3 mg/cm$^3$).

A doctor blade 413 held in contact with the developing roller 402 regulates the amount of the toner deposited on the developing roller 402 and thereby forms a thin toner layer having uniform thickness. More specifically, the doctor blade 413 has its edge oriented toward the downstream side in the direction rotation of the developing roller 402 and has its intermediate portion held in contact with the roller 402. Of course, the doctor blade 413 may be oriented in the direction counter to the direction of rotation of the developing roller 402, if desired. The doctor blade 413 is formed of SUS 304 or similar metal and is 0.1 mm to 0.15 mm thick. Alternatively, the doctor blade 413 may be implemented as a 1.2 mm thick, polyurethane rubber or similar rubber blade or a relatively hard resin blade, in which case carbon black, for example, will be added to lower resistance.

The doctor blade 413 should preferably protrude from a holder by 10 mm to 15 mm. A length above 15 mm, as measured from the holder, would make the developing device 4 bulky while a length below 10 mm would cause the doctor blade 413 to oscillate in contact with the developing roller 402 and would thereby cause unexpected horizontal stripes to appear in an image. The doctor blade 413 should preferably be pressed against the developing roller 402 by a pressure of 0.049 N/cm to 2.45 N/cm (5 gf/cm to 250 gf/cm). A pressure above 2.45 N/cm would reduce the toner deposited on the developing roller 402 while excessively charging the toner and would thereby reduce the amount of development and there fore image density. A pressure below 0.049 N/cm would prevent the toner from forming a thin, uniform layer and would allow the toner to pass the blade 413 in the form of lumps, thereby critically degrading image quality. In a specific example of the illustrative embodiment, the developing roller 402 had a hardness of 30° (JIS-A scale) while the doctor blade 413 was implemented as a 0.1 mm thick SUS plate and pressed against the roller 402 by 650 gf/cm. The developing roller 402 and doctor blade 413 were successful to deposit a target amount of toner on the developing roller 402.

The doctor blade 413 oriented toward the downstream side should preferably be inclined by 10° to 45° relative to a line tangential to the developing roller 402. The doctor blade 413 forms a thin toner layer having a target thickness of 0.4 mg/cm$^2$ to 0.8 mg/cm$^2$ by removing needless portion of the toner from the developing roller 402. At this instant, the toner is charged to −10 $\mu$C/g to −30 $\mu$C/g in the illustrative embodiment.

Figure 32:
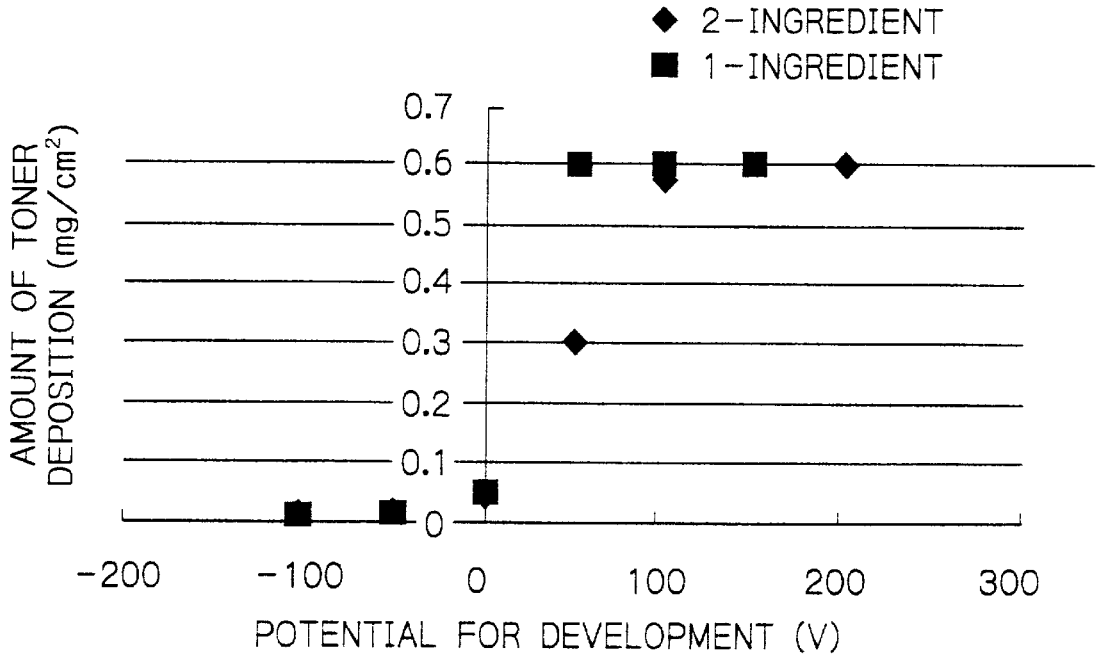
FIG. 32 is a graph showing a gamma characteristic particular to the embodiment of FIG. 31.

In the illustrative embodiment, the gap between the drum 1 and the developing roller 402 is even smaller than the gap assigned to the two-ingredient type developer, enhancing the developing ability and further lowering the required potential. More specifically, as shown in FIG. 32 showing data derived from a single-component developer, saturation development was achieved even with a potential for development VP of 50 V.

At the developing position A1, the toner layer present in the region between the drum 1 and the developing roller 402 and where it contributes to development has the capacity $C_{TL}$ for a unit area, as stated earlier. Also, the photoconductive layer 1P of the drum 1 has the capacity $C_{PC}$ for a unit area. In the illustrative embodiment, the material and thickness of the layer 1P and those of the toner are selected such that the capacity $C_{TL}$ is greater than the capacity $C_{PC}$. This successfully reduces the edge effect to thereby prevent thin lines and small dots from thickening, i.e., faithfully develops a latent image on the drum 1.

A further alternative embodiment of the present invention, which is also mainly directed toward the second object, will be described hereinafter. This embodiment is identical with the embodiment described with reference to FIGS. 1, 2 and 3 as to the general construction of the printer and the configurations of the process unit and developing device. The following description will therefore concentrate on features unique to the illustrative embodiment.

In the illustrative embodiment, the drum 1 has the rigid, aluminum tube as a base. In light of this, the developing roller 402 should advantageously be formed of rubber whose hardness is between 10° and 70° (JIS-A scale). The developing roller 402 should preferably have a diameter ranging from 10 mm to 30 mm. In the illustrative embodiment, the diameter of the developing roller 402 is selected to be 16 mm. Again, the surface of the developing roller 402 is suitably roughened to a roughness Rz of 1 μm to 4 μm (ten-point mean roughness), which allows the toner to be conveyed without being buried in the surface of the roller 402.

Rubber for the developing roller 402 may be silicone rubber, butadiene rubber, NBR, hydrine rubber or EPDM by way of example. When the drum 1 is replaced with a photoconductive belt, the developing roller 402 does not need low hardness and may therefore be formed of metal. It is preferable to coat the surface of the developing roller 402 with suitable coating material in order to stabilize quality against aging. Moreover, the developing roller 402 of the illustrative embodiment should only carry the toner, i.e., it does not have to charge the toner by friction. The developing roller 402 therefore should only satisfy resistance, surface property, hardness and dimensional accuracy and can be selected from a broad range of materials.

The coating material for the developing roller 402 may be chargeable to polarity opposite to the polarity of the toner 10 or, if the frictional charging function is not necessary, to the same polarity as the toner 10. Materials chargeable to opposite polarity to the toner 10 include silicone resin, acrylic resin, polyurethane and other resins and rubber-containing materials. Materials chargeable to the same polarity as the toner 10 include fluorine-containing materials. Particularly, Teflon-based materials containing fluorine have low surface energy and a desirable parting ability and, therefore suffer from a minimum of toner filming.

Resins generally applicable to the above coating material include polytetrafluoroethylene (PTFE), tetrafluoroethylene perfluoroalkyl vinylether (PFT), tetrafluoroethylene-hexafluoropropylene polymer (FEP), polychrlorotrifuloroethylene (PCTFE), tetrafluoroethylene-ehtylene copolymer (ETFE), chlorotrifluoroethylene-ethylene copolymer (ECTFE), polyvinylidene fluoride (PVDF), and polyvinyl fluoride (PVF). Carbon black or similar conductive material is, in many cases, added to such resin. Further, other resins are sometimes mixed with the above resin to implement uniform coating.

As for resistance, a bulk volume resistivity inclusive of the coating layer is set. Specifically, the resistance of the base layer is so controlled as to set a resistivity of $10^3$ Ω·cm to $10^8$ Ω·cm. In the illustrative embodiment, the volume resistivity of the base layer is between $10^3$ Ω·cm and $10^5$ Ω·cm, so that the surface layer is sometimes provided with a slightly higher volume resistivity.

Figure 33A:
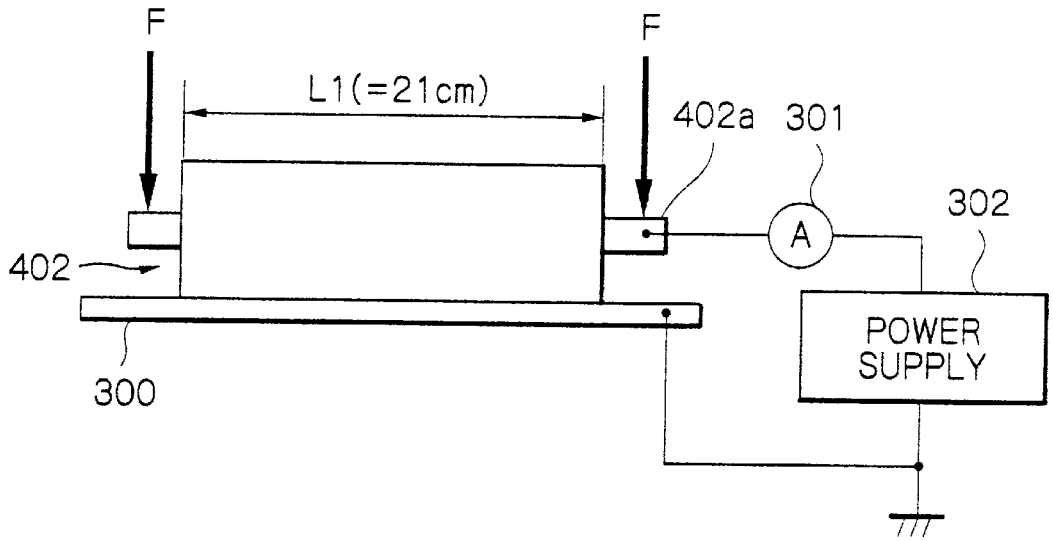
FIGS. 33A and 33B show a specific system for measuring volume resistivity of the surface layer of a developing roller included in the developing device of FIG. 31.
Figure 33B:
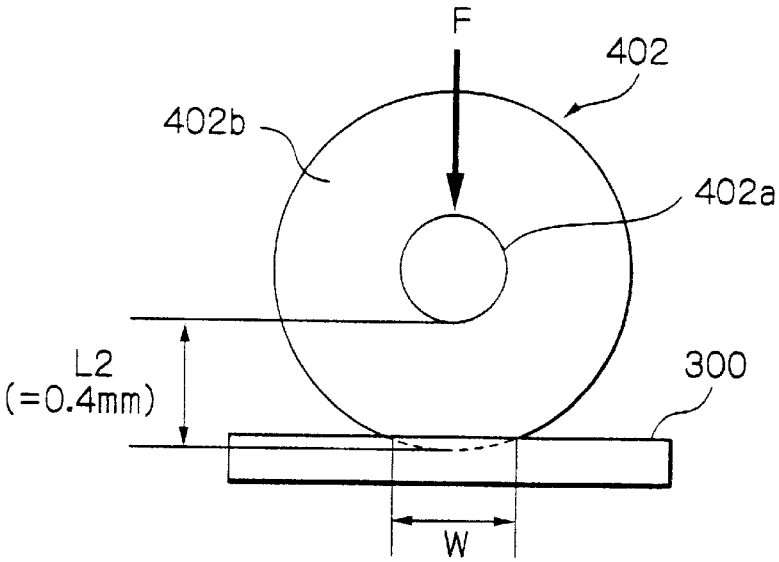

To measure the volume resistivity of the surface of the developing roller 402, use was made of a system shown in FIGS. 33A and 33B. First, as shown in FIG. 33A, the developing roller 402 is set on a conductive base 300 connected to ground. A weight F of 4.9 N (=500 gf) is applied to opposite ends of the core or shaft 402*a* of the roller 402, so that a total weight F of 9.8 N (1 kgf) acts on the roller 402. As a result, a nip W is formed between the roller 402 and the base 300. A DC power supply 302 is connected to the core 402*a* of the roller 402 via an ammeter 301. While a DC voltage of V of 1 V is applied from the power supply 302 to the core 402*a*, the resulting current I (A) is read. The voltage V1 and current I, as well as the various dimensions L1 (cm), L2 (cm) and W (cm), are used to determine the volume resistivity ρv of the elastic layer 402*b* of the roller 402:

$$\rho v=(V/I)\cdot(L1\times W)/L2 \qquad \text{Eq. (5)}$$

The coating layer of the developing roller 402 should preferably have a thickness ranging from 5 μm to 50 μm. If the coating layer is thicker than 50 μm and if a difference in hardness between such a coating layer and the base layer is great, then the coating layer is apt to crack due to stress. Thickness below 5 μm is likely to cause the base layer to show itself due to wear and thereby cause the toner to deposit thereon.

The illustrative embodiment is identical with the embodiment described with reference to FIGS. 14 through 30 as to the composition and volume mean grain size of the toner 10 as well as to the grain size and resistance of the magnetic grains 11.

In the illustrative embodiment, the sleeve 408 of the magnet brush roller 403 has a diameter of 18 mm and has its surface roughened to a surface roughness Rz (ten-point mean roughness) of 10 μm to 20 μm by sand blasting. The amount of charge to deposit on the magnet brush roller 403 should preferably lie in the range of from −10 μC/g to −40 μC/g.

In the illustrative embodiment, the gap between the doctor blade 406 and the magnet brush roller 403 is selected to be 500 μm at the position where the blade 406 and roller 403 are closest to each other. Also, the drum 1 and developing roller 402 are rotated at a linear velocity of 200 m/sec and a linear velocity of 300 mm/sec, respectively. The gap between the developing roller 402 and the magnet brush roller 403 is selected to be 0.6 mm, as measured at the toner feeding position A2.

The illustrative embodiment and a conventional developing device using a single-ingredient developer will be compared hereinafter with respect to the charge of the toner deposited on the magnet brush roller 403 and the charge of the toner deposited on the developing roller 402 in the form of a thin layer. FIG. 34 shows the results of measurement conducted with the illustrative embodiment and conventional developing device by using the same toner. Background contamination ranks are based on the previously stated value ΔID. For example, rank "3" corresponds to ΔID ranging from 0.08 to 0.04.

As shown in FIG. 34, in the conventional developing device, toner is deposited on the developing roller in an amount as great as 1 mg/cm$^2$ to 3 mg/cm$^2$. Although a doctor blade scrapes off part of such an amount of toner, toner with a broad range of charges presumably pass the doctor blade. As a result, although the mean charge of the toner was as great as −12 μC/g in a thin layer, the resulting image belonged to rank "3" that was an average rank. By contrast, in the illustrative embodiment, rank "5" was achieved although the charge of the toner deposited on the developing roller 402 during development was also −12 μC/g. The illustrative embodiment is therefore superior to the conventional developing device as to image quality.

Further, it was experimentally found that the following relation was achievable with the illustrative embodiment between the grain size and charge distribution of toner deposited on the developing roller 402 and image quality. To measure the grain size and charge distribution, use was made of the analyzer ESPART ANALYZER mentioned earlier. For the experiments, 3,000 toner grains were sampled in order to determine a difference in distribution.

So long as charge uniformly exits over the entire toner grain, the amount of charge is proportional to the third power of the grain size. In practice, however, the amount of charge is proportional to the grain size itself. For this reason, the distribution of the number of toner grains was measured with respect to a value produced by dividing the amount of charge q by the grain size d and therefore free from the influence of the grain size.

Figure 35:
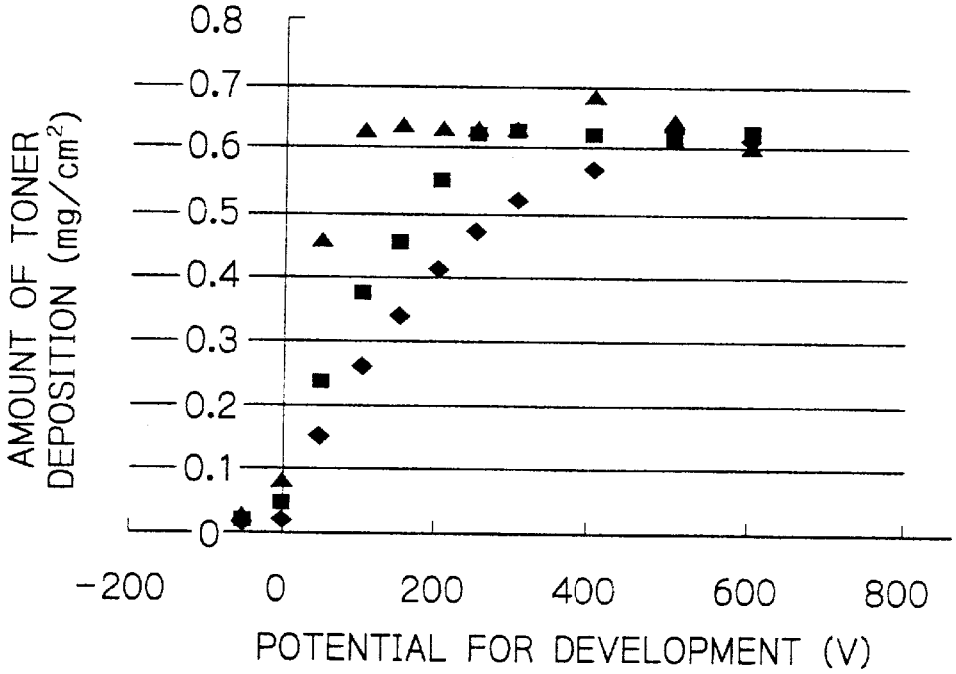
FIG. 35 is a graph showing a relation between the potential for development and the amount of toner deposition.

FIG. 35 plots the charges of the toner deposited on the developing roller 402 and measured by the analyzer. In FIG. 35, rhombs relate to the illustrative embodiment while squares relate to the conventional developing device not including the magnet brush roller. As FIG. 35 indicates, the charge distribution of the toner 10 deposited on the developing roller 402 of the illustrative embodiment has a sharper profile than the distribution of the conventional developing device.

Generally, a half value is used as an index representative of the sharpness of the above profile; the smaller the half value, the sharper the profile. Generally, a sharp profile shows that a number of toner grains having similar amounts of charge q/d are present. Such grains equivalent in developing ability implement uniform development. Conversely, a broad profile means a broad range of charges deposited on the toner and therefore a broad range of developing abilities, causing the amount of development to fluctuate.

Figure 36:
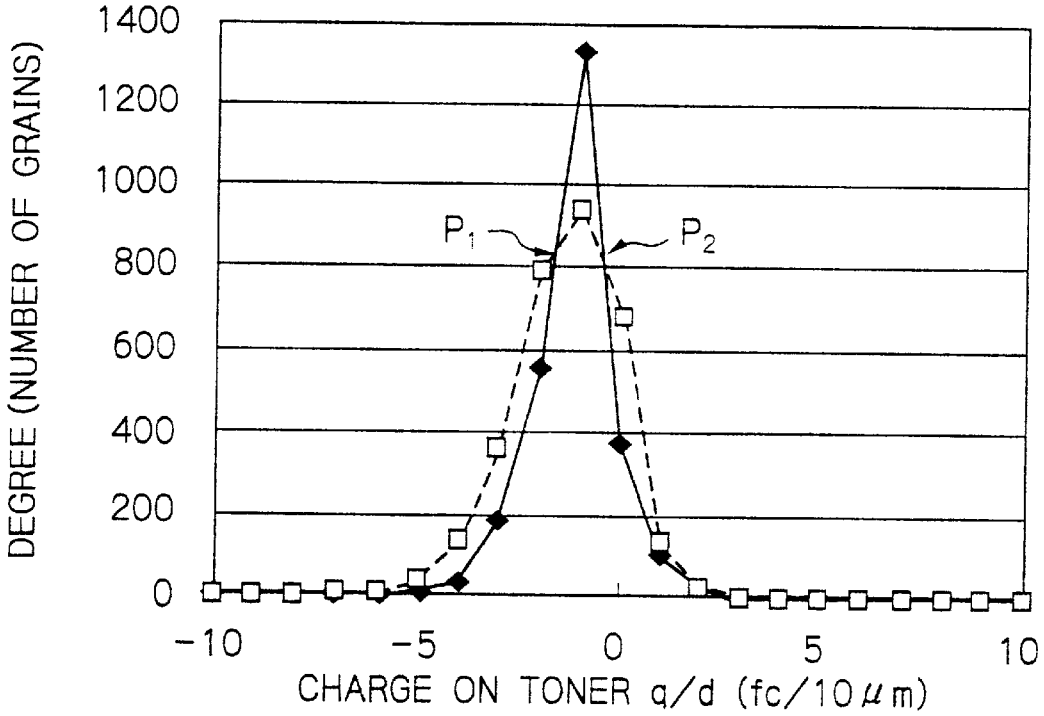
FIG. 36 is a graph showing a relation between the amount of toner charge and the degree (number of toner grains)

FIG. 36 shows the results of experiments in more detail. As shown, in the conventional developing device, many toner grains are distributed in the ranges of the amount of charge q/d outside of points P1 and P2 where two curves intersect each other, compared to the illustrative embodiment. In the left range of FIG. 36 where the absolute value of q/d is great, the amount of charge and therefore a force available for development is great. However, because the electric field for development attenuates as the development proceeds, much of the toner deposited on the developing roller cannot contribute to development. As a result, part of the toner is left on the developing roller. In the right range of FIG. 36 where the absolute value of q/d is small, the amount of charge is dependent on the amount of charge of the drum and is therefore likely to increase the amount of development. In addition, it is likely that the background is contaminated by the grains low in charge or charged to the opposite polarity.

As for the portion where the amount of charge q/d lies in a broad range as in the illustrative embodiment, the number of grains in channels at both sides of a channel having the peak value should optimally be 50% or less of the number of grains of the channel having the peak value. In this manner, the illustrative embodiment whose q/d distribution is sharp can implement uniform development and therefore high image quality. In this connection, in the illustrative embodiment, the channels at both sides of the channel having the peak q/d value each were 35% of the channel having the peak value as to the number of grains. This ratio was as great as 78% in the conventional developing device. The interval between nearby channels is 1 fC/10 $\mu$m.

As stated above, the illustrative embodiment allows only the charged toner grains to be transferred from the magnet brush formed on the magnet brush roller 403 to the developing roller 402. This makes it needless to frictionally charge the toner deposited on the developing roller 402 with a doctor blade or similar contact member. The contact member would cause toner filming to occur on the developing roller and would cause the developing characteristic to vary due to the wear of the developing roller and that of the contact member.

In the illustrative embodiment, the charge distribution of the toner differs from the developing roller 402 to the magnetic brush roller 403. Therefore, even when the desired toner charge distribution is not available on the magnet brush roller 403 due to, e.g., a limited frictional charging characteristic, the distribution is set up on the developing roller 402. This insures high quality toner images free from background contamination and short image density (omission of dots). In addition, because background contamination does not occur, the amount of toner to remain on the drum 1 after image transfer is reduced, promoting. the miniature configuration of the cleaning device 6.

Further, the toner deposited on the developing roller 402 involves a minimum of irregularity in the amount of charge, stable, saturation development is achievable. This is particularly true with the bilevel process stated earlier. Consequently, stable images, free form background contamination and short density (omission of dots) are-stably attainable.

Moreover, in the illustrative embodiment, the capacity $C_{TL}$ for a unit area at the particular region at the developing position A1 is selected to be greater than the capacity $C_{PC}$ of the photoconductive layer 1P, as stated earlier. Such a relation is successful to reduce the edge effect during development to thereby prevent thin lines and small dots from thickening, thereby insuring faithful, uniform image reproduction.

Particularly, when the developing roller 402 includes the elastic layer 402*b*, as in the illustrative embodiment, it is preferable that the sum of the dielectric thickness of the elastic layer 402*b* and that of the toner layer between the roller 402 and the drum 1 is not greater than three times of the dielectric thickness of the photoconductive layer 1P. Images were experimentally formed by varying the above dielectric thicknesses. FIG. 37 shows the experimental results.

In FIG. 37, experiment No. 1 was conducted under the above-described conditions. When the thickness of the photoconductive layer 1P was varied to 15 m (No. 1) or to 20 m (No. 2), the edge effect was aggravated to thicken thin lines. When the permittivity of the developing roller 402 particular to No. 2 was increased or when the thickness of the rubber layer of the roller 402 particular to No. 2 was increased (No. 5), the edges of an image were improved. In short, when the sum of the dielectric thickness of the elastic layer of the developing roller 402 and that of the toner layer was less than three times of the dielectric thickness of the conductive layer 1P, uniform images with a minimum of edge effect were achieved.

While the illustrative embodiment has also concentrated on negative-to-positive development, the present invention is similarly applicable to positive-positive development.

The illustrative embodiment is applicable even to a intermediate image transfer type of image forming apparatus that transfers a toner image from a photoconductive drum to an intermediate image transfer body and then transfers it from the intermediate image transfer body to a recording medium, and a developing device for the same. This kind of image forming apparatus may be implemented as a color image forming apparatus constructed to sequentially form toner images of different colors on a single photoconductive drum, transfer the toner images to an intermediate image transfer belt one above the other, and then transfer the resulting composite toner image to a paper sheet. A tandem image forming apparatus to which the present invention is also applicable includes a plurality of image forming units each including a respective photoconductive drum and arranged side by side along an intermediate image transfer belt.

The present invention is, of course, applicable not only the printer shown and described, but also to a copier, facsimile apparatus or similar image forming apparatus.

As stated above, the second, third and fourth embodiments achieve various advantages, as enumerated below.

(1) Assume toner grains around the image portion of a latent image formed on the photoconductive element of the image carrier. Then, the edge electric field attracting the above toner grains toward the photoconductive layer is weakened to such a degree that the edge effect is not visible by eye. This prevents thin lines and small dots from thickening and thereby realizes faithful, uniform image reproduction. This is also true when use is made of a two-ingredient type developer or a one-ingredient type developer.

(2) There can be reduced a potential necessary for forming an electric field for development having preselected strength at the developing position. It is therefore possible to implement low-potential development and therefore to reduce the electrostatic fatigue of the photoconductive layer and background contamination.

(3) When the toner carrier or developer carrier has the dielectric surface layer formed on the conductive base, the advantage (1) is also achievable.

(4) Toner with a minimum of irregularity in the amount of charge is deposited on the toner carrier. This, coupled with the fact that toner of short charge or charged to the opposite polarity is reduced, reduces background contamination.

(5) The life of the photoconductive layer is extended.

(6) A density difference between a line image and a solid image is reduced, so that the faithful production of a latent image is further promoted.

(7) The edge effect can also be reduced to the previously stated degree when use is made of a negative-to-positive type of developing device or a positive-to-positive type of developing device.

Various modifications will become possible for those skilled in the art after receiving the teachings of the present disclosure without departing from the scope thereof.

What is claimed is:

1. An image forming apparatus comprising:

an image carrier including a photoconductive layer formed on a conductive base;

latent image forming means for uniformly charging a surface of said image carrier and then scanning said surface with a light beam in accordance with image data to thereby form a latent image;

a developing device for depositing toner on a toner carrier, which includes a conductive base, and causing said toner carrier to convey said toner to a developing position where said toner carrier faces said image carrier to thereby develop the latent image and produce a corresponding toner image;

a power supply for applying a bias $V_B$ for development to said conductive base of said toner carrier; and an image transferring device for transferring the toner image from said image carrier to a recording medium;

wherein assuming that a capacity and a resistance between said conductive base of said toner carrier and a surface of said photoconductive layer in the developing position are $C_D$ (F/cm$^2$) and $R_D$ (Ω/cm$^2$), respectively, that said photoconductive layer has a capacity of $C_P$ (F/cm$_2$) and a resistance, as measured in a thickness of direction, of $R_P$ (Ω/cm$^2$), and that a potential for development that is a difference between a potential $V_L$ of an image portion of said image carrier and the bias $V_B$ ($V_L$−$V_B$) is 300 V or below in absolute value, then $C_D$, $R_D$, $C_P$, and $R_P$, are selected such that an amount of charge $Q_P$ to be charged into said capacity $C_P$ for a unit area within a period of time in which the surface of said image carrier moves away from the developing position is $2.5\times10^{-9}$ C/cm$^2$ in absolute value.

2. The apparatus as claimed in claim 1, wherein assuming that the resistances $R_D$ and $R_P$ are selected such that the capacities $C_D$ and $C_P$ are fully charged within said period of time, a serial connection of said capacities $C_D$ and $C_P$ have a composite capacity $C_T$ of $8.3\times10^{-12}$ F/cm$^2$ or above.

3. The apparatus as claimed in claim 2, wherein a smaller one of the capacities $C_D$ and $C_P$ is $8.3\times10^{-12}$ F/cm$^2$.

4. The apparatus as claimed in claim 1, wherein assuming that the resistance $R_D$ is lower than the resistance $R_P$, the capacity $C_P$ is $8.3\times10^{-12}$ F/Cm$^2$.

5. The apparatus as claimed in claim 4, wherein in a gamma characteristic representative of a variation of an amount of charge (Q/A) (C/cm$^2$) of the toner deposited on said image carrier with respect to the potential for development $V_L$−$V_B$ (V) , a rising portion has a slope α of $3\times10^{-12}$ F/cm$^2$ or above.

6. The apparatus as claimed in claim 1, wherein the toner deposited on said toner carrier has a mean amount of charge of between 5 C/g and 35 μC/g in absolute value.

7. The apparatus as claimed in claim 1, wherein assuming that said period of time is $T_D$, then the resistance $R_D$ is $T_D/\alpha$ or below.

8. The apparatus as claimed in claim 7, wherein the resistance $R_D$ is between $1\times10^3$ Ω/cm$^2$ and $2.4\times10^3$ Ω/cm$^2$.

9. The apparatus as claimed in claim 1, wherein the toner carrier comprises an elastic layer formed on the conductive substrate and a surface protection layer formed on a surface of said elastic layer.

10. In an image forming apparatus comprising:

an apparatus body;

an image carrier including a photoconductive layer formed on a conductive base;

latent image forming means for uniformly charging a surface of said image carrier and then scanning said surface with a light beam in accordance with image data to thereby form a latent image;

a developing device for depositing toner on a toner carrier, which includes a conductive base, and causing said toner carrier to convey said toner to a developing position where said toner carrier faces said image carrier to thereby develop the latent image and produce a corresponding toner image;

a power supply for applying a bias $V_B$ for development to said conductive base of said toner carrier; and an image transferring device for transferring the toner image from said image carrier to a recording medium;

an image forming process unit includes said image carrier and said developing device and is bodily removable from said apparatus body, and assuming that a capacity and a resistance between said conductive base of said toner carrier and a surface of said photoconductive layer in the developing position are $C_D$ (F/cm$^2$) and $R_D$ (Ω/cm$^2$), respectively, that said photoconductive layer has a capacity of $C_P$ (F/cm$_2$) and a resistance, as measured in a thickness of direction, of $R_P$ (Ω/cm$^2$), and that a potential for development that is a difference between a potential $V_L$ of an image portion of said image carrier and the bias $V_B$ ($V_L$−$V_B$) is 300 V or below in absolute value, then $C_D$, $R_D$, $C_P$ and $R_P$ are selected such that an amount of charge $Q_P$ to be charged into said capacity $C_P$ for a unit area within a period of time in which the surface of said image carrier moves away from the developing position is $2.5\times10^{-9}$ C/cm$^2$ in absolute value.

11. The apparatus as claimed in claim 10, wherein assuming that the resistances $R_D$ and $R_P$ are selected such that the capacities $C_D$ and $C_P$ are fully charged within said period of time, a serial connection of said capacities $C_D$ and $C_P$ have a composite capacity $C_T$ of $8.3\times10^{-12}$ F/cm$^2$ or above.

12. The apparatus as claimed in claim 11, wherein a smaller one of the capacities $C_D$ and $C_P$ is $8.3\times10^{-12}$ F/cm$^2$.

13. The apparatus as claimed in claim 10, wherein assuming that the resistance $R_D$ is lower than the resistance $R_P$, the capacity $C_P$ is $8.3\times10^{-12}$ F/cm$^2$.

14. The apparatus as claimed in claim 13, wherein in a gamma characteristic representative of a variation of an amount of charge (Q/A) (C/cm$^2$) of the toner deposited on said image carrier with respect to the potential for development $V_L-V_B$ (V), a rising portion has a slope $\alpha$ of $3\times10^{-12}$ F/cm$^2$ or above.

15. The apparatus as claimed in claim 10, wherein the toner deposited on said toner carrier has a mean amount of charge of between 5 C/g and 35 $\mu$C/g in absolute value.

16. The apparatus as claimed in claim 10, wherein assuming that the period of time is $T_D$, then the resistance $R_D$ is $T_D/\alpha$ or below.

17. The apparatus as claimed in claim 16, wherein the resistance $R_D$ is between $1\times10^3$ Ω/cm$^2$ and $2.4\times10^8$ Ω/cm$^2$.

18. The apparatus as claimed in claim 10, wherein the toner carrier comprises an elastic layer formed on the conductive substrate and a surface protection layer formed on a surface of said elastic layer.

19. An image forming apparatus comprising:

an apparatus body; an image carrier including a photoconductive layer formed on a conductive base;

latent image forming means for uniformly charging a surface of said image carrier and then scanning said surface with a light beam in accordance with image data to thereby form a latent image;

a developing device for depositing toner on a toner carrier, which includes a conductive base, and causing said toner carrier to convey said toner to a developing position where said toner carrier faces said image carrier to thereby develop the latent image and produce a corresponding toner image;

a power supply for applying a bias $V_B$ for development to said conductive base of said toner carrier; and an image transferring device for transferring the toner image from said image carrier to a recording medium;

wherein a region adjoining the surface of said image carrier at the developing position and where the toner contributing to development exists has a capacity $C_{TL}$ for a unit area greater than a capacity $C_{PC}$ of said photoconductive layer for a unit area.

20. The apparatus as claimed in claim 19, wherein said toner carrier magnetically causes a two-ingredient type developer consisting of the toner and magnetic grains to form a brush thereon, and the capacity $C_{TL}$ is a capacity of said region, which is positioned at a tip of the brush at an image carrier side, for a unit area.

21. The apparatus as claimed in claim 20, wherein the magnetic grains have a dynamic resistance of $10^7$ Ω or below.

22. The apparatus as claimed in claim 19, wherein said toner carrier carries a one-ingredient type developer containing the toner, and the capacity $C_{TL}$ is a capacity of a toner layer formed between the surface of said image carrier and a surface of said toner carrier at the developing position for a unit area.

23. The apparatus as claimed in claim 22, wherein said toner carrier has a surface layer formed on said conductive base, and a sum of a dielectric thickness of said surface layer and a dielectric thickness of the toner layer, as measured at the developing position, is not greater than three times of a dielectric thickness of said photoconductive layer.

24. The apparatus as claimed in claim 22, wherein said developing device comprises a toner feed member for conveying a two-ingredient type developer, which consists of the toner and magnetic grains, to a toner feeding position where said toner feed member faces said toner carrier, whereby said toner is fed from said toner feed member to said toner carrier.

25. The apparatus as claimed in claim 22, wherein there holds a relation:

$$|V_O|\leq|V_{max}|/2$$

where $V_O$ denotes a charge potential deposited on said photoconductive layer, and $V_{max}$ denotes a maximum allowable value of said charge potential.

26. The apparatus as claimed in claim 19, wherein assuming a gamma characteristic curve representative of a relation between a developing potential $V_L-V_B$, which is a difference between a potential VL of an image portion of said image carrier and the bias VB, and an amount of the toner deposited on said image carrier, a slope of a rising portion of said gamma characteristic curve and a potential for development at a time when said amount of said toner begins to saturate remain the same for both of development of a line image and development of a solid image.

27. The apparatus as claimed in claim 19, wherein said latent image forming means forms a latent image for negative-to-positive development on said image carrier, and said developing device develops the latent image by negative-to-positive development.

28. The apparatus as claimed in claim 19, wherein said latent image forming means forms latent image for positive-to-positive development on said image carrier, and said developing device develops the latent image by positive-to-positive development.

29. In an image forming apparatus comprising:

an apparatus body;

an image carrier including a photoconductive layer formed on a conductive base;

latent image forming means for uniformly charging a surface of said image carrier and then scanning said surface with a light beam in accordance with image data to thereby form a latent image;

a developing device for depositing toner on a toner carrier, which includes a conductive base, and causing said toner carrier to convey said toner to a developing position where said toner carrier faces said image carrier to thereby develop the latent image and produce a corresponding toner image;

a power supply for applying a bias $V_B$ for development to said conductive base of said toner carrier; and an image transferring device for transferring the toner image from said image carrier to a recording medium;

an image forming process unit includes said image carrier and said developing device and is bodily removable from said apparatus body, and a region adjoining the surface of said image carrier at the developing position and where the toner contributing to development exists has a capacity $C_{TL}$ for a unit area greater than a capacity $C_{PC}$ of said photoconductive layer for a unit area.

30. The apparatus as claimed in claim 29, wherein said toner carrier magnetically causes a two-ingredient type developer consisting of the toner and magnetic grains to form a brush thereon, and the capacity $C_{TL}$ is a capacity of said region, which is positioned at a tip of the brush at an image carrier side, for a unit area.

31. The apparatus as claimed in claim 30, wherein the magnetic grains have a dynamic resistance of $10^7$ Ω or below.

32. The apparatus as claimed in claim 29, wherein said toner carrier carries a one-ingredient type developer containing the toner, and:

the capacity $C_{TL}$ is a capacity of a toner layer formed between the surface of said image carrier and a surface of said toner carrier at the developing position for a unit area.

33. The apparatus as claimed in claim 32, wherein said toner carrier has a surface layer formed on said conductive base, and a sum of a dielectric thickness of said surface layer and a dielectric thickness of the toner layer, as measured at the developing position, is not greater than three times of a dielectric thickness of said photoconductive layer.

34. The apparatus as claimed in claim 32, wherein said developing device comprises a toner feed member for conveying a two-ingredient type developer, which consists of the toner and magnetic grains, to a toner feeding position where said toner feed member faces said toner carrier, whereby said toner is fed from said toner feed member to said toner carrier.

35. The apparatus as claimed in claim 32, wherein there holds a relation:

$$|V_O| \leqq |V_{max}|/2$$

where $V_O$ denotes a charge potential deposited on said photoconductive layer, and $V_{max}$ denotes a maximum allowable value of said charge potential.

36. The apparatus as claimed in claim 29, wherein assuming a gamma characteristic curve representative of a relation between a developing potential $V_L - V_B$, which is a difference between a potential VL of an image portion of said image carrier and the bias VB, and an amount of the toner deposited on said image carrier, a slope of a rising portion of said gamma characteristic curve and a potential for development at a time when said amount of said toner begins to saturate remain the same for both of development of a line image and development of a solid image.

37. The apparatus as claimed in claim 29, wherein. said latent image forming means forms a latent image for negative-to-positive development on said image carrier, and said developing device develops the latent image by negative-to-positive development.

38. The apparatus as claimed in claim 29, wherein said latent image forming means forms a latent image for positive-to-positive development on said image carrier, and said developing device develops the latent image by positive-to-positive development.

* * * * *